US009843102B2

(12) United States Patent
Lai et al.

(10) Patent No.: US 9,843,102 B2
(45) Date of Patent: Dec. 12, 2017

(54) SHORTED BOWTIE PATCH ANTENNA WITH PARASITIC SHORTED PATCHES

(71) Applicant: City University of Hong Kong, Kowloon (HK)

(72) Inventors: Hau Wah Lai, Kowloon (HK); Ka Ming Mak, New Territories (HK); Kwai Man Luk, Kowloon (HK); Chi Hou Chan, Kowloon Tong (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 50 days.

(21) Appl. No.: 14/542,364

(22) Filed: Nov. 14, 2014

(65) Prior Publication Data

US 2016/0141757 A1 May 19, 2016

(51) Int. Cl.

| | |
|---|---|
| ***H01Q 19/00*** | (2006.01) |
| ***H01Q 9/28*** | (2006.01) |
| ***H01Q 9/04*** | (2006.01) |

(52) U.S. Cl.

CPC ..... *H01Q 19/005* (2013.01); *H01Q 9/0457* (2013.01); *H01Q 9/285* (2013.01)

(58) Field of Classification Search

CPC .... H01Q 9/285; H01Q 9/0414; H01Q 9/0421; H01Q 9/0457

USPC ..... 343/797

See application file for complete search history.

(56) References Cited

U.S. PATENT DOCUMENTS

| | | | | |
|---|---|---|---|---|
| 4,922,263 | A * | 5/1990 | Dubost | H01Q 9/065 343/700 MS |
| 5,774,094 | A | 6/1998 | Yonezaki | |
| 5,784,032 | A * | 7/1998 | Johnston | H01Q 1/243 343/702 |
| 6,373,446 | B2 * | 4/2002 | Apostolos | H01Q 9/28 343/700 MS |
| 6,429,819 | B1 | 8/2002 | Bishop et al. | |
| 6,618,016 | B1 * | 9/2003 | Hannan | H01Q 1/28 343/705 |
| 2013/0222199 | A1 * | 8/2013 | Apostolos | H01Q 9/28 343/795 |
| 2014/0002317 | A1 * | 1/2014 | Wunsch | H01Q 1/3283 343/713 |
| 2014/0197994 | A1 * | 7/2014 | Hossain | H01Q 1/273 343/700 MS |

FOREIGN PATENT DOCUMENTS

WO 0161784 A1 8/2001

OTHER PUBLICATIONS

Wong, et al., "Directional Wideband Shorted Bowtie Antenna," Microwave and Optical Technology Letters / vol. 48, No. 8, pp. 1670-1672, Aug. 2006.

(Continued)

*Primary Examiner* — Daniel J Munoz

(74) *Attorney, Agent, or Firm* — Amin, Turocy & Watson, LLP

(57) ABSTRACT

Described herein are shorted bowtie patch antennas. The shorted bowtie patch antenna includes parasitic shorted patches. Signals are received by the shorted bowtie patch antenna. The received signals are propagated to a receiver. Signals sent from a transmitter are transmitted by the shorted bowtie patch antenna. Current is induced in the parasitic shorted patches during receiving and transmitting of signals.

21 Claims, 25 Drawing Sheets

(56) References Cited

OTHER PUBLICATIONS

Wong, et al., "Wideband Shorted Bowtie Patch Antenna With Electric Dipole". IEEE Transactions on Antennas & Wireless Propagation, vol. 56, No. 7, Jul. 2008, 4 pages.
Mak, et al., "A Shorted Bowtie Patch Antenna with a Cross Dipole for Dual Polarization," IEEE Antennas & Wireless Propagation Letters, vol. 6, Apr. 2007, 4 pages.
Mak, et al., "A Circularly Polarized Antenna With Wide Axial Ratio Beamwidth," IEEE Transactions on Antennas & Propagation, vol. 57, No. 10, pp. 3309-3312, Oct. 2009.

* cited by examiner

1400

2000

SHORTED BOWTIE PATCH ANTENNA WITH PARASITIC SHORTED PATCHES

TECHNICAL FIELD

This disclosure relates generally to antennas for numerous wireless applications, e.g., for high performance.

BACKGROUND

An antenna is an electrical device that converts electric power into radio waves, and/or vice versa. Antennas are usually used with, or provided as part of, a radio transmitter and/or radio receiver. They are used in systems such as radio broadcasting, television, radar, cell phones, satellite communications, radio frequency identification (RFID) tags, etc.

Antennas can be mounted on a surface or can be included in such systems. Size restrictions of various systems impose limits on sizes of antennas. In such systems, an antenna can include a conductive line or pattern formed by a printed circuit conductor. An example of such antennas, is the "patch" antenna. Patch antennas may include a printed circuit conductor area. Such patch antennas may suffer from limited bandwidth capability. A bowtie patch antenna comprises triangular patches that are fed either through a microstrip line on their surface or by lines originating on different conductor layers. Such bowtie shaped patch antennas generally consist of two triangular shaped patches which converge at the points of the triangles.

The above-described background relating to antennas for various wireless applications is merely intended to provide a contextual overview of antenna technology, and is not intended to be exhaustive. Other context regarding antennas may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the purpose of this summary is to present some concepts related to some exemplary non-limiting embodiments in simplified form as a prelude to more detailed descriptions of the various embodiments that follow in the disclosure.

Described herein are systems, methods, articles of manufacture, and other embodiments or implementations that can facilitate the use of parasitic bowtie patch antennas. Parasitic bowtie patch antennas can be implemented in connection with any type of device with a connection to a communications network (a wireless communications network, the Internet, or the like), such as a mobile handset, a computer, a handheld device, or the like.

A variety of bowtie antennas on the market suffer from poor performance, platform dependency, and increased size. However, the embodiments of shorted bowtie patch antennas presented herein provide several advantages such as simple structures, platform independence, low profile, and low back radiation, which are less susceptible to surface condition of the mounting body.

In various embodiments, a geometry of the shorted bowtie patch antenna described herein can comprise shorted patches arranged in a bowtie configuration and parasitic shorted patch arranged in a bowtie configuration. The shorted patches can drive the antenna and induce current in the parasitic shorted patches. A low profile shorted bowtie patch antenna can comprise a pair of shorted bowtie patches with the addition of a pair of parasitic shorted patches in between the bowtie patches.

According to one embodiment, described herein is a method for creating a shorted bowtie patch antenna comprising parasitic patch elements. The method can provide several advantages to bowtie patch antennas including reduced size and increased performance.

These and other embodiments or implementations are described in more detail below with reference to the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
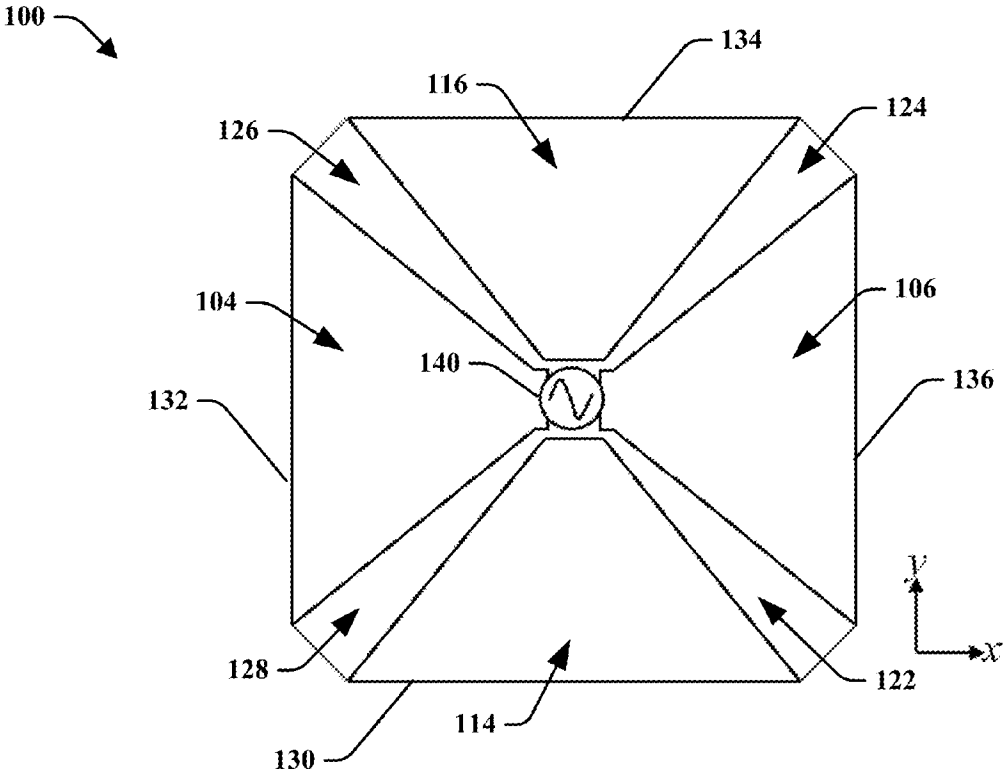
FIG. 1 illustrates a schematic of an example shorted bowtie patch antenna comprising parasitic patch elements, in accordance with various embodiments disclosed herein.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

As utilized herein, terms "component," "system," "interface," and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer and/or distributed between two or more computers.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification schemes and/or systems (e.g., support vector machines, neural networks, expert systems, Bayesian belief networks, fuzzy logic, and data fusion engines) can be employed in connection with performing automatic and/or inferred action in connection with the disclosed subject matter.

As an overview of the various embodiments presented herein, to correct for the above identified deficiencies and other drawbacks of patch antennas, various embodiments are described herein to facilitate shorted bowtie patch antennas with a low profile and increased performance.

Conventionally, decreasing the size of an antenna results in low gain and high back radiation. Low gain limits the communication distance and high back radiation may distribute energy in unintended directions. Therefore, to obtain a certain gain and low back radiation, the antenna size cannot fall below a limited size. The size of the antenna is normally less than one wavelength in free space. In some available antennas, a large ground plane (or reflector) is used to reduce the back radiation of an antenna. However, in doing so, the antenna size is increased. Embodiments described herein can be utilized to reduce a front-to-back ratio of antennas. For instance, the front-to-back ratio can be enhanced from 15 dB in conventional antennas to 30 dB with a length shorter than $0.77\lambda_0$ in embodiments described herein.

In another aspect, the operating environments of antennas (e.g., the casing, the attached circuitry, the material of a mounting object, etc.) can affect the performance of the antenna (e.g., the impedance of an antenna). Conventionally, different designs are needed for different environments. As such, the performance of conventional antennas can be drastically different when operating in free space or mounting on different surfaces. For example, in RFID tag antennas, the performance of the tag antenna becomes poor or varies when mounting the tag antenna on different material surfaces, such as on or near a human body or a metallic surface. Additionally, the size of the mounting object can also affect the performance of an antenna. Various embodiments described herein can facilitate a shorted bowtie patch antenna that can have a stable radiating performance, including radiation patterns, reflection coefficients, and gain, irrespective of types of mounting surfaces.

Figure 2:
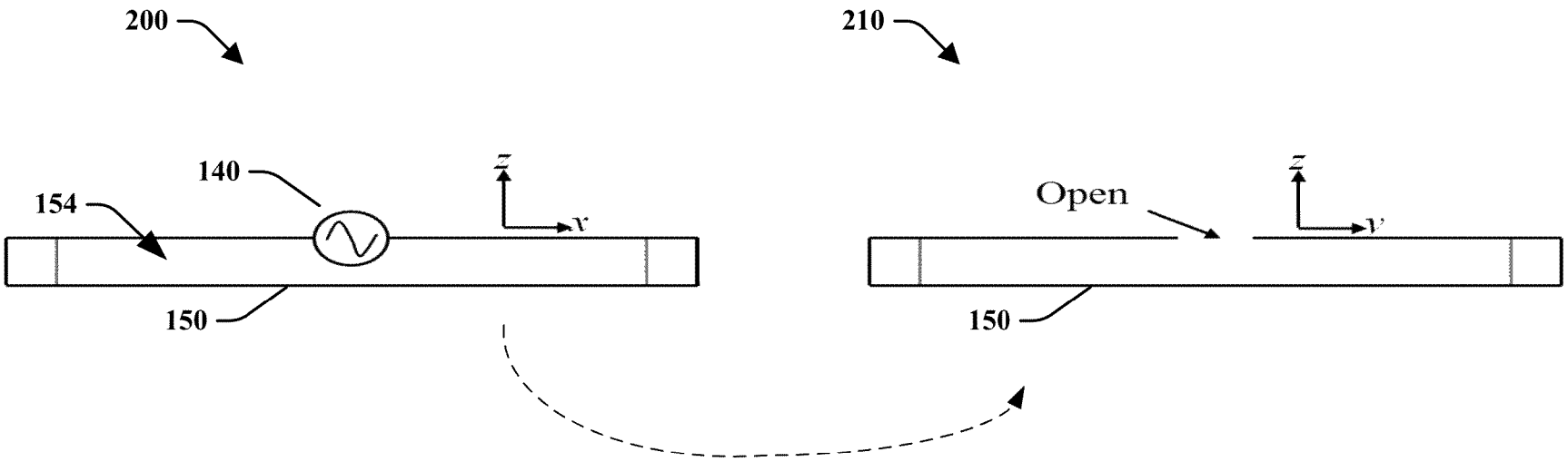
FIG. 2 illustrates side views of a schematic of an example shorted bowtie patch antenna with parasitic patch elements, in accordance with various embodiments disclosed herein.

Referring now to FIGS. 1 and 2, illustrated are schematics of an example shorted bowtie patch antenna 100 with a pair of parasitic patch elements. In an aspect, FIG. 1 depicts a top view of shorted bowtie patch antenna 100 and FIG. 2 depicts side view 200 and a rotated side view 210 of shorted bowtie patch antenna 100. The shorted bowtie patch antenna 100 comprises shorted patch elements 104 and 106, parasitic shorted patch elements 114 and 116, a feeding source 140, and ground plane element 150. Shorted bowtie patch antenna 100 can further comprise slot elements 122, 124, 126, and 128 and shorting walls 130, 132, 134, and 136.

In embodiments, shorted bowtie patch antenna 100 is disposed in relation to ground plane element 150. Ground plane element 150 can be associated with a larger device, may be a separate conductive element, and/or may be associated with a printed wiring board. In at least one embodiment, ground plane element 150 can be a metallic substance. As depicted, shorting walls 130, 132, 134, and 136 can be connected to ground plane element 150, shorted patch elements 104, 106, and/or parasitic shorted patch elements 114 and 116. A shorting wall or other shorting element (e.g., shorting pins) shorts a patch element by electrically connecting the patch element to a ground (e.g., ground plane 150). Slot elements 122, 124, 126, and 128 are disposed on a top side of shorted bowtie patch antenna 100 while ground plane element 150 is disposed on a bottom side of shorted bowtie patch antenna 100. In some embodiments, slot elements 122, 124, 126, and 128 can be etched into a surface of a material. It is noted that slot elements 122, 124, 126, and 128 may be considered a conductor-absent element of shorted bowtie patch antenna 100.

In another aspect, each patch element (e.g., shorted patch elements 104, 106, and parasitic shorted patch elements 114 and 116) can form a cavity 154 with ground plane element 150 and/or respective shorting walls 130, 132, 134, and 136. It is noted that the patch elements can collectively form a cavity 154 with ground plane element 150 and/or can form multiple cavities with ground plane element 150. Cavity 154 can be wholly or partially comprised by air or another dielectric, such as a dielectric substrate material. It is further noted that the dielectric can be a solid, liquid, and/or gas. For example, cavity 154 can comprise a dielectric attached to a patch element, attached to a ground plane 150, attached to a shorting wall, attached to a portion of various elements, or the like. In various embodiments, the dielectric material can comprise one or more disparate materials. In an aspect, the dielectric material can be larger than shorted bowtie patch antenna 100, such that shorted bowtie patch antenna 100 can be hidden or partially hidden inside a dielectric material. In another aspect, filling or partially filling cavity 154 with a dielectric material can contribute to reducing the size of shorted bowtie patch antenna 100.

In various embodiments, shorted bowtie patch antenna 100 can facilitate transmitting and/or receiving signals. For instance, feeding source 140 can be a feeding source located at the center of shorted bowtie patch antenna 100 or at one or more other positions. Feeding source 140 can be connected (e.g., via a wire line, etc.) to larger devices. In an aspect, a signal generator (e.g., a transmitter) can propagate a signal to feeding source 140 and shorted bowtie patch antenna 100 can transmit the signal through a medium (e.g., air). In another aspect, shorted bowtie patch antenna 100 can receive a signal and can propagate the signal to a device connected to feeding source 140 (e.g., a receiver). It is noted that shorted bowtie patch antenna 100 can be configured to transmit and/or receive various signals.

In embodiments, shorted patch elements 104 and/or 106 are electromagnetically coupled to conductive element 140, while parasitic shorted patch elements 114 and 116 are not electrically connected to conductive element 140, which can be connected to a transmitter or receiver. Parasitic shorted patch elements 114 and 116 are connected to shorted patch elements 104 and/or 106 (and to each other) through proximity, and are tuned so that their currents will be in the appropriate phases to enhance the directionality of shorted bowtie patch antenna 100. That is, parasitic shorted patch elements 114 and 116 are electrically disconnected (e.g., electrically isolated) but inductively coupled to other patch elements. In an aspect, shorted patch elements 104 and/or 106 can be driving patches via current received from a transmitter and thereby induce current to parasitic shorted patch elements 114 and 116. In an aspect, the induction by parasitic shorted patch elements 114 and 116 can constructively contribute in radiating electromagnetic fields.

For instance, during transmissions, shorted patch elements 104 and/or 106 can be driven by current from a transmitter connected through feeding source 140 such that shorted patch elements 104 and 106 are not electromagnetically coupled. Current is induced to parasitic shorted patch elements 114 and 116 and the induced current contributes in radiating electromagnetic fields. During reception of a signal, shorted patch elements 104 and/or 106 may be considered a driving patch that drives a receiver connected through feeding source 140. As the signal is received, current is induced to parasitic shorted patch elements 114 and 116 and the induced current contributes in receiving radiated electromagnetic fields. As depicted, parasitic shorted patch elements 114 and 116 are in sufficient proximity to shorted patch elements 104 and/or 106 for induction. In particular, shorted patch elements 104 and/or 106 are respectively spaced at a distance (e.g., width of slot element) from parasitic shorted patch elements 114 and/or 116, so that electromagnetic radiation emitted by shorted patch elements 104 and/or 106 is coupled, inductively or otherwise, to parasitic shorted patch elements 114 and 116 to assist in transmission of a signal associated with shorted bowtie patch antenna 100. Electromagnetic radiation received by parasitic shorted patch elements 114 and 116 is coupled to shorted patch elements 104 and/or 106 to assist in reception of a signal by shorted bowtie patch antenna 100. It is noted that one or more of parasitic shorted patch elements 114 and 116 can comprise layers of parasitic shorted patch elements. Likewise, various embodiments can comprise different numbers or arrangements of the various patch elements.

In at least one embodiment, a single feed source (e.g., feeding source 140) can be connected to conductive element. During transmission, a signal can be propagated from feeding source 140 to shorted patch elements 104 and/or 106. In an aspect, parasitic shorted patch elements 114 and 116 are not electrically connected to the feeding source 140.

In embodiments, shorted bowtie patch antenna 100 can be attached or affixed to a surface. The surface can be virtually any surface, such as consumer electronics, consumer goods, metallic surfaces, plastic surfaces, ceramic surfaces, organic surfaces (e.g., a user, an animal, etc.) and the like. For example, shorted bowtie patch antenna 100 can be utilized as an RFID tag for shipping logistics. The RFID tag can be attached (e.g., removably and/or permanently) to an article of manufacture, shipping container, or the like. RFID tags of one or more of the various embodiments described herein can be attached to the particular surface or object with little or no modification. In some embodiments, performance of the RFID tag may not degrade (or substantially degrade) when attached to different surfaces. For instance, shorted bowtie patch antenna 100 can experience low back radiation, low cross polarization, symmetrical radiation pattern, and stable radiation pattern over a frequency bandwidth. In another aspect, shorted bowtie patch antenna 100 can be utilized in on-body applications, Wi-Fi devices, biometric applications, and the like.

Various embodiments described herein refer to a bowtie or butterfly shape or configuration of patch elements. In a bowtie configuration, patches comprise a triangular shape or other shape having a distal end and a central end. The distal end is greater in width than the central end such that the sides taper towards the center end. In another aspect, central ends of a plurality of patches converge in a central position. For example, shorted patch elements 104 and 106 each taper towards a central position, such as the position of feeding source 140. Further, shorted patch elements 104 and 106 are arranged opposite each other in a mirror or symmetric fashion along a central point. It is noted that slot elements 122, 124, 126, and 128 may also be in a bowtie shape or configuration.

In another aspect, shorted bowtie patch antenna 100 can be thought of as having a "t" (or cross) configuration or shape. In the t-shape, pairs of patches and/or slots intersect to form a t-shape. For instance, shorted patch elements 104 and 106 form a bowtie shape and parasitic shorted patch elements 114 and 116 form another bowtie shape. The pair of bowtie shapes intersect or are centralized at a reference point, such as the position of feeding source 140.

Figure 3:
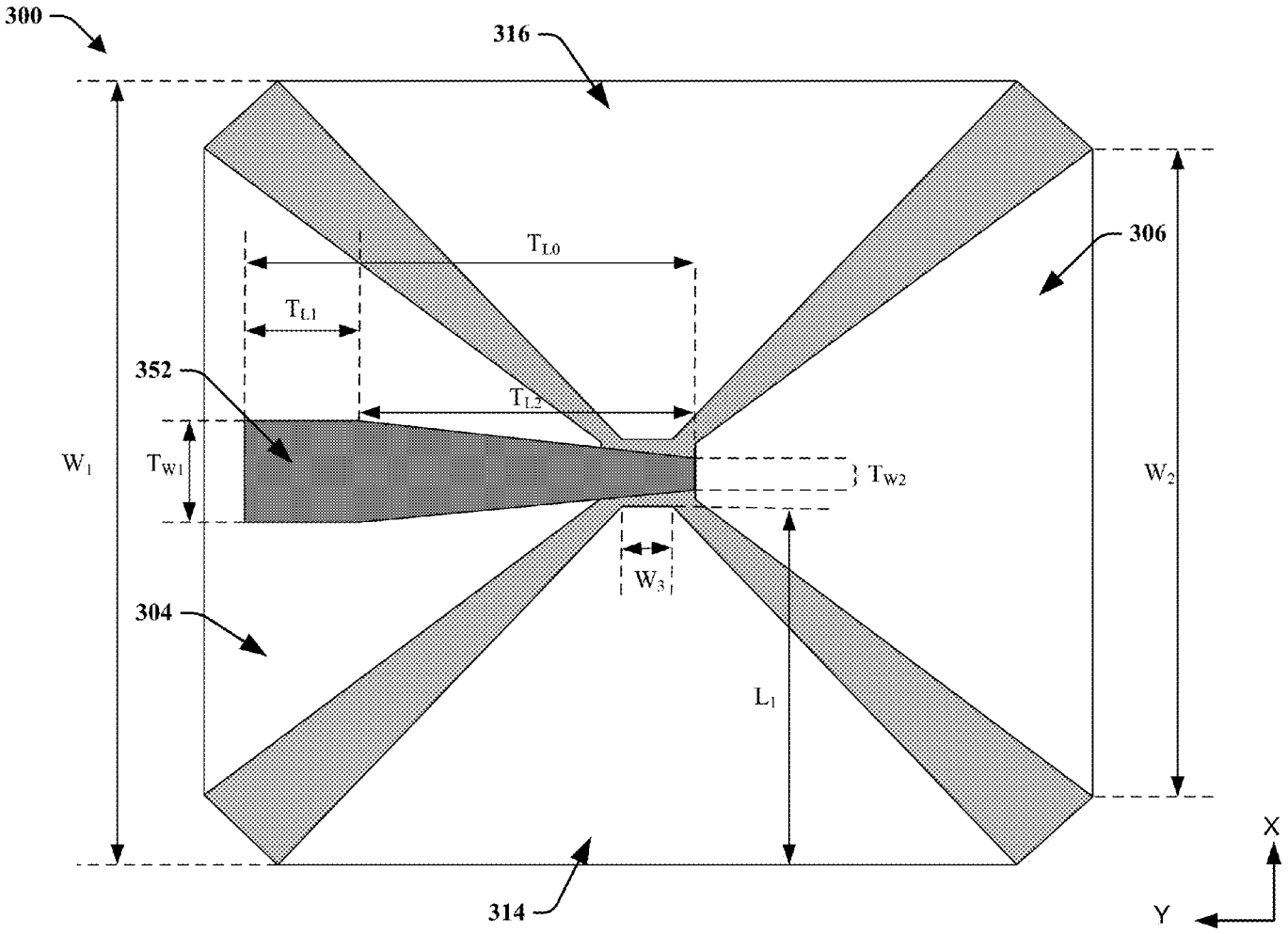
FIG. 3 illustrates a schematic of an example shorted bowtie patch antenna comprising parasitic patch elements and a feed line, in accordance with various embodiments disclosed herein.
Figure 4:
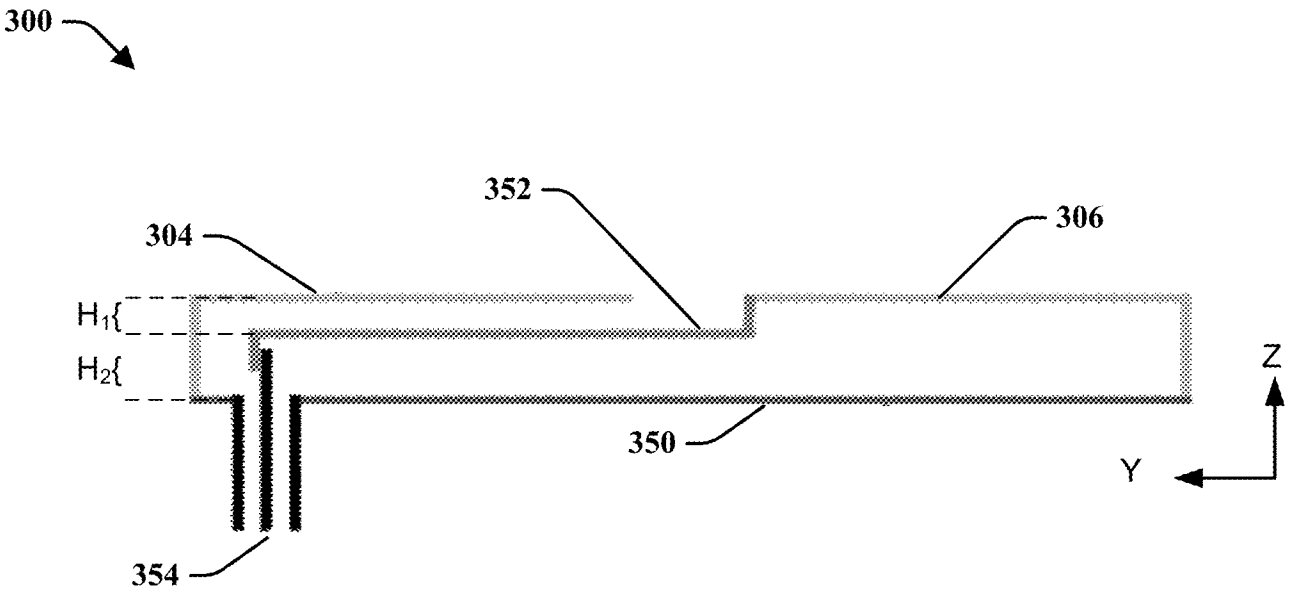
FIG. 4 illustrates a schematic cross sectional view of an example shorted bowtie patch antenna comprising parasitic patch elements and a feed line, in accordance with various embodiments disclosed herein.

Turning now to FIGS. 3 and 4, illustrated is a schematic of an example shorted bowtie patch antenna 300 with a pair of parasitic patch elements and a feed line. FIG. 3 depicts a first or top view of shorted bowtie patch antenna 300 and FIG. 4 depicts a cross sectional side view of shorted bowtie patch antenna 300. It is noted that shorted bowtie patch antenna 300 can comprise all or some elements and/or functionality described with reference to the various figures (e.g., FIGS. 1, 2, etc.). As depicted, shorted bowtie patch antenna 300 can comprise shorted patch elements 304 and 306, parasitic shorted patch elements 314 and 316, and feed line 352. In an aspect, feed line 352 can be connected to a conductive element. In another aspect, a conductive element can comprise feed line 352. In embodiments, feed line 352 can be a metallic tapered air microstrip line and/or other feed line that can facilitate feeding (e.g., providing a current to) shorted bowtie patch antenna 300.

In an exemplary embodiment, shorted bowtie patch antenna 300 can be utilized in applications associated with a determined band (e.g., 5.8 GHz ISM band). In at least one embodiment, the geometry of shorted bowtie patch antenna 300 can include the various shorted patches (e.g., shorted patch elements 304 and 306, and parasitic shorted patch elements 314 and 316) having identical or substantially identical dimensions. It is noted that other embodiments can comprise shorted patch elements having different dimensions and/or a different number of patches.

In one or more embodiments, the various patch elements can have a width ($W_2$) and a length ($L_1$). For example, $W_2$ can be about $0.7\lambda_0$ and $L_1$ can be about $0.35\lambda_0$. The profile of shorted bowtie patch antenna 300 can be about $0.02\lambda_0$ and the length of the ground plane ($W_1$) can be about $0.77\lambda_0$. Feed line 352 can comprise horizontal length ($T_{L0}$) that comprises the length of a non-tapered portion ($T_{L1}$) and a length of a tapered portion ($T_{L2}$). For instance, $T_{L0}=T_{L1}+T_{L2}$ and $T_{L0}$ can be about $0.128\lambda_0$. It is appreciated that feed line 352 can be below a patch element (e.g., shorted patch element 306 as depicted). Thus, the height of feed line 352 ($H_1$) is sufficiently small enough to fit within a cavity formed between shorted patch element 304 and a ground plane such that feed line 352 can be connected (e.g., permanently and/or removably) to a cable (e.g., coaxial cable 354). For example, $H_1$ can be about $0.02\lambda_0$. One end of feed line 352 can be connected to a shorter edge of a shorted patch element (e.g., shorted patch elements 304 and/or 306) and the other end of feed line 352 can be connected to an inner connector that can receive and/or transmit a signal. For instance, the inner connector can be connected to coaxial cable 354 (e.g., a 50Ω coaxial cable). The outer connector of the coaxial cable can be connected to a ground plane element 350 and the other end of the coaxial cable can be connected to a larger device, such as via a SubMiniature version A (SMA) connector. It is noted that other feeding systems can be utilized, such as direct feed systems and capacitive feed systems. It is noted that part or all of feed line 352 may be comprised within a dielectric material. It is further noted that a cavity formed by the various patch elements and a ground plane can comprise one or more dielectric materials. It is noted that dimensions described herein are for exemplary purposes. As such the dimensions may or may not be exact. Likewise, embodiments can comprise different dimensions and/or configurations.

Figure 5:
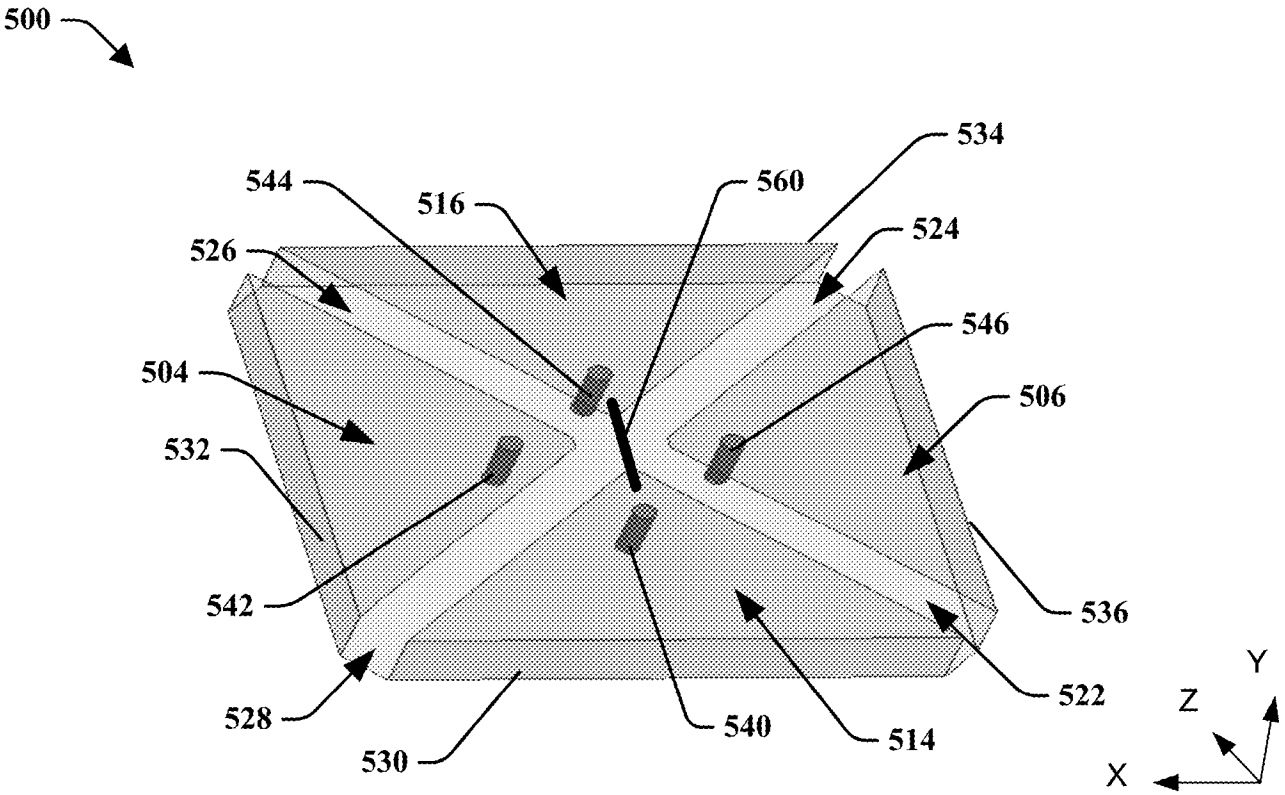
FIG. 5 illustrates a schematic of an example shorted bowtie patch antenna comprising parasitic patch elements and feeding pins, in accordance with various embodiments disclosed herein.

Turning now to FIG. 5, illustrated is a schematic of an example shorted bowtie patch antenna 500 comprising a pair of parasitic patch elements and feeding probes in a perspective view. It is noted that shorted bowtie patch antenna 500 can comprise all or some elements and/or functionality described with reference to the various figures. As depicted, shorted bowtie patch antenna 500 comprises shorted patch elements 504 and 506, parasitic shorted patch elements 514 and 516, slot elements 522, 524, 526, and 528, shorting walls 530, 532, 534, and 536, conductive elements 540, 542, 544, and 546, and bridge element 560.

Conductive elements 540, 542, 544, and/or 546 can be connected to a feeding source for transmitting and receiving signals. As depicted, conductive elements 540, 542, 544, and 546 can comprise four feed probes. For linear polarization of signals, either conductive elements 540 and 544 or conductive elements 542 and 546 are fed by a differential source. For dual polarization, two differential sources can be utilized. Various embodiments can utilize different methods or configurations to generate a differential source. For example, shorted bowtie patch antenna 500 can comprise a wideband power divider. The wideband power divider can comprise one input port and two output ports. The two output ports can be of equal or substantially equal magnitude and/or out-of-phase. One feeding network is connected to conductive elements 540 and 544; while the other feeding network is connected to conductive elements 542 and 546.

In some embodiments, bridge element 560 may be included in shorted bowtie patch antenna 500. Bridge element 560 can be introduced to connect the shorter edge of parasitic shorted patch elements 514 and 516 or shorted patch elements 504 and 506.

Figure 6:
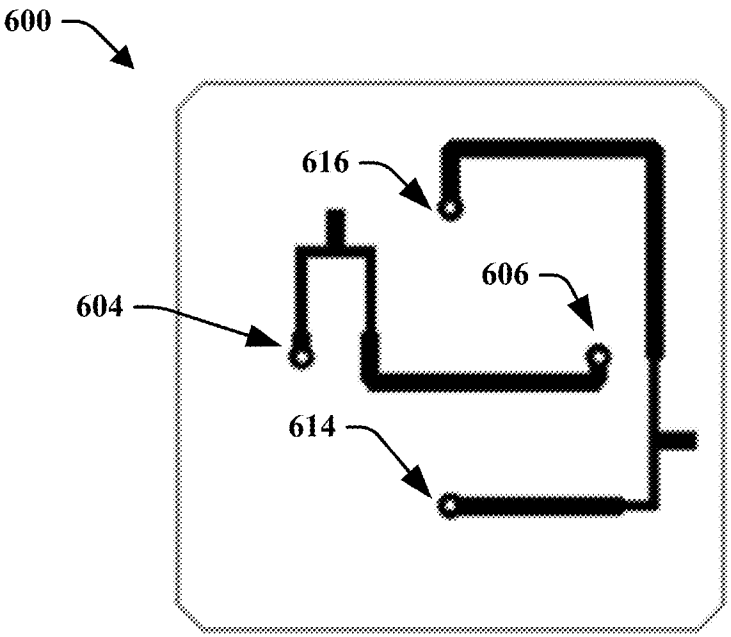
FIG. 6 illustrates a schematic of an example feeding systems, in accordance with various embodiments disclosed herein.

FIG. 6 illustrates is a schematic of an example system 600 that can provide a feeding source for a shorted bowtie patch antenna (e.g., shorted bowtie patch antenna 500). System 600 can comprise two different feeding networks. A first feeding network can comprise connections 604 and 606, and a second feeding network can comprise connections 614 and 616. With reference to FIG. 5, the first feeding network can be connected (e.g., via connections 604 and 606) to conductive elements 542 and 546. The second feeding network can be connected (e.g., via connections 614 and 616) to conductive elements 540 and 544. The two output ports can be of equal or substantially equal magnitude and/or out-of-phase. In an aspect, system 600 can provide for dual linear polarization of a shorted bowtie patch antenna.

Figure 7:
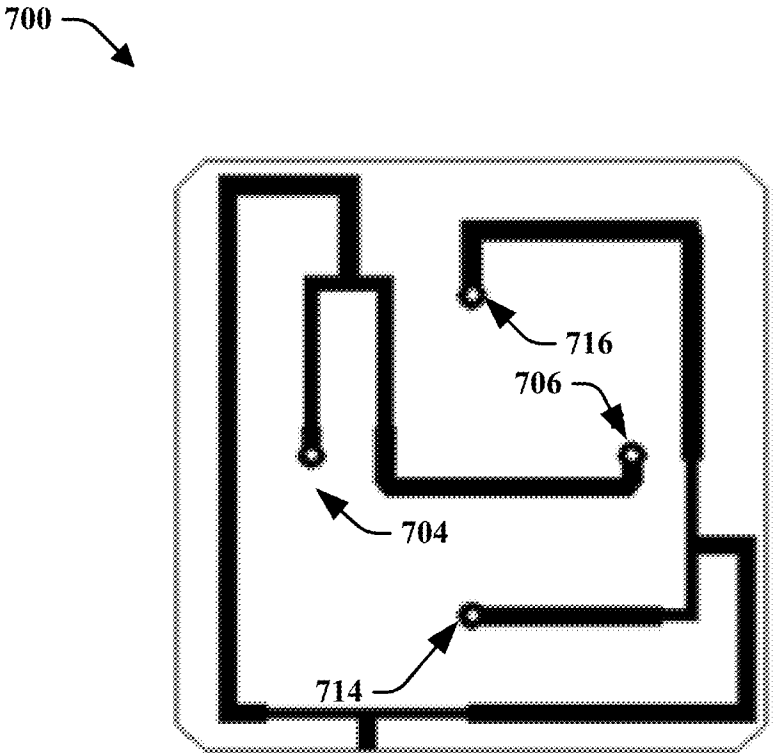
FIG. 7 illustrates a schematic of an example feeding system for circular polarization, in accordance with various embodiments disclosed herein.

Turning to FIG. 7, with reference to FIG. 5, illustrated is a schematic of an example system 700 that can provide a power divider for a feeding source configured for circular polarization of a shorted bowtie patch antenna (e.g., shorted bowtie patch antenna 500). In an aspect, system 700 can comprise sequential connections 704, 706, 714, and 718. Sequential connection 704 can be connected to conductive element 542, sequential connection 706 can be connected to conductive element 546, sequential connection 714 can be connected to conductive element 540, and sequential connection 716 can be connected to conductive element 544.

Circular polarization of an electromagnetic wave is a polarization in which the electric field of the passing wave does not change strength but only changes direction in a rotary manner. An electric field vector defines the strength and direction of an electric field. In the case of a circularly polarized wave, the tip of the electric field vector, at a given point in space, describes a circle as time progresses. If the wave is frozen in time, the electric field vector of the wave describes a helix along the direction of propagation.

Figure 8:
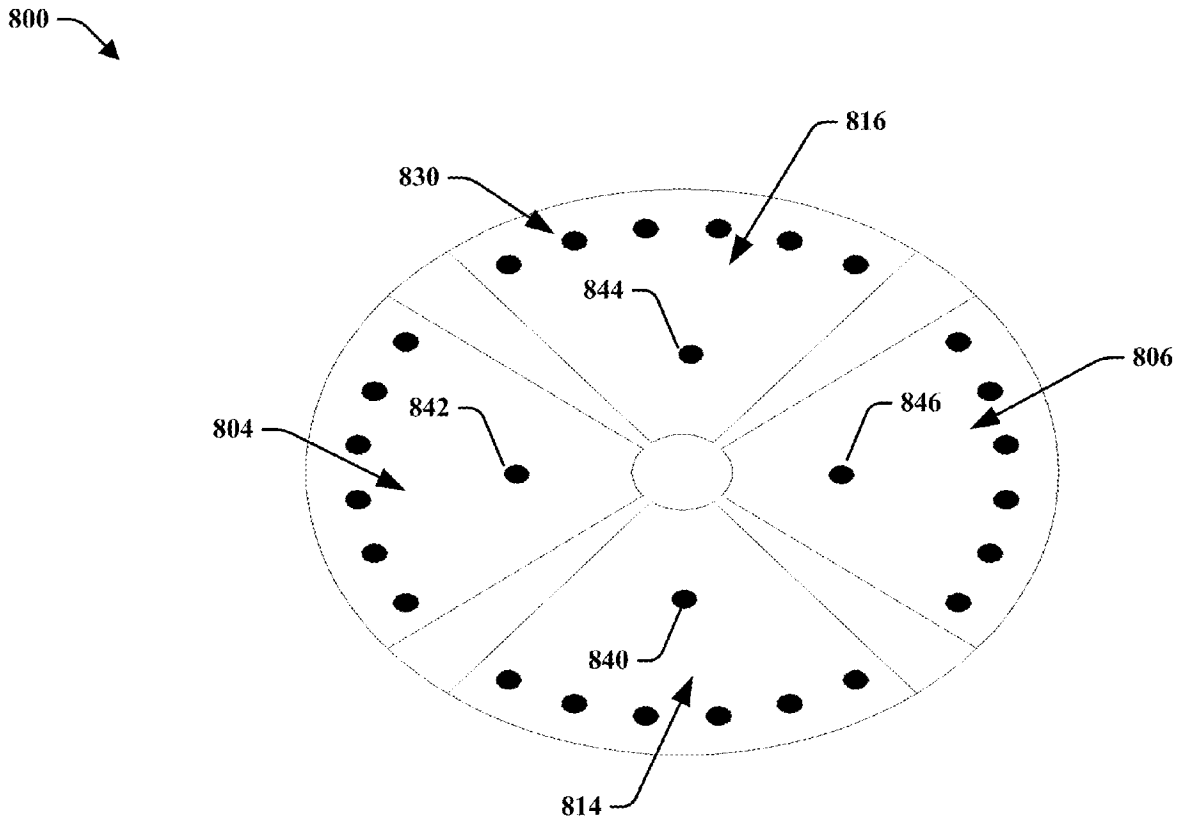
FIG. 8 illustrates a schematic of an example round shorted bowtie patch antenna comprising parasitic patch elements and shorting pins, in accordance with various embodiments disclosed herein.

FIG. 8 illustrates a schematic of an example circular or elliptical shorted bowtie patch antenna 800 comprising a pair of parasitic patch elements and shorting pins. Shorted bowtie patch antenna 800 can comprise shorted patch elements 804 and 806, parasitic shorted patch elements 814 and 816, shorting elements 830, and conductive elements 840, 842, 844, and 846. It is appreciated that conductive elements 840, 842, 844, and 846 can be replaced by a different number of conductive elements (e.g., as in FIG. 1).

As depicted, shorted patch elements 804/806 and parasitic shorted patch elements 814/816 are depicted as triangular wedges of a circle. It is noted that such patch elements can comprise various other shapes. Moreover, such shapes may represent triangles, wedges, or the like, but may have variations, such as one or more curved sides, irregularly shaped sides, etc. In aspect, the shapes of patches can be triangle like with a vertex (or a portion representing a vertex) pointed at a center or other reference point. In another aspect, the shape of the shorted bowtie patch antenna 800 can be various shapes depending on a desired configuration, such as rectangles, triangles, circles, ellipsis, N-side polygons, irregular shapes, and the like.

Shorting elements 830 can comprise shorting pins, a series of non-connected shorting walls, or the like. For example, FIG. 8 depicts shorting elements 830 as cylindrical shorting pins, however the shorting pins can be various other shapes. Moreover, the shorting pins can comprise different dimensions with respect other pins. In an aspect, the shorting elements 830 connect respective patch elements and a ground plane (e.g., ground plane element 150, etc.).

Figure 9:
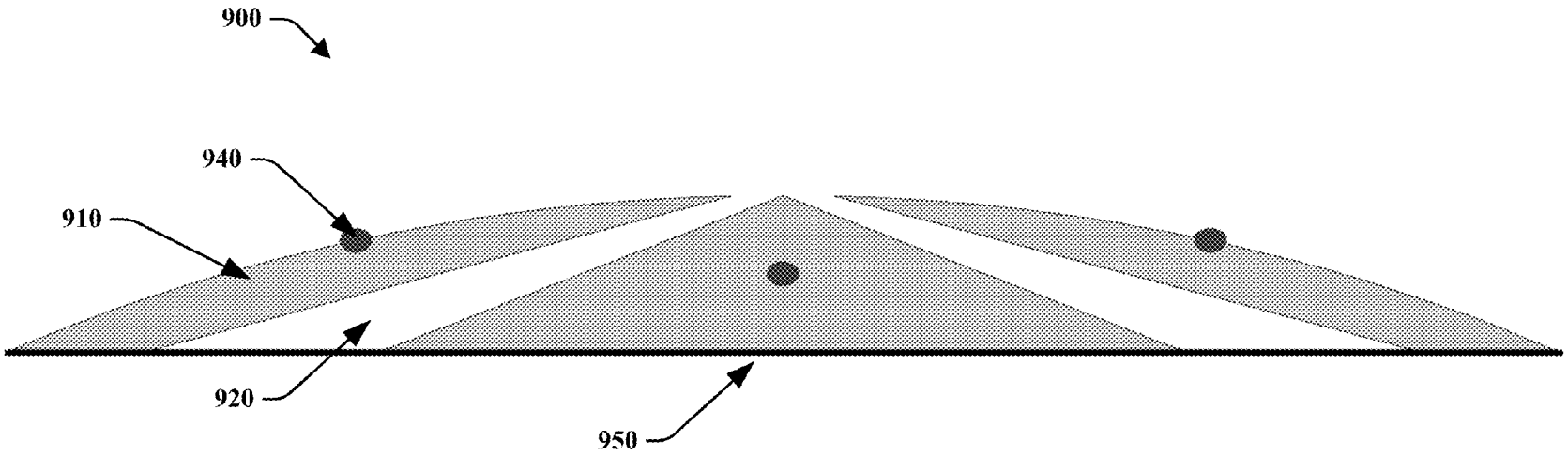
FIG. 9 illustrates a schematic of an example curved shorted bowtie patch antenna comprising parasitic patch elements, in accordance with various embodiments disclosed herein.

Turning to FIG. 9, illustrated is a schematic of an example shorted bowtie patch antenna 900 in a curved configuration. It is noted that shorted bowtie patch antenna 900 can comprise all or some elements and/or functionality described with reference to the various figures disclosed herein. Shorted bowtie patch antenna 900 can primarily comprise curved patches 910 (e.g., shorted patches and parasitic shorted patches), slots 920, conductive elements 940, and ground plane 950. It is noted that shorted bowtie patch antenna 900 can comprise other or different elements not shown for readability. For instance, shorted bowtie patch antenna 900 can comprise shorting elements, a different number of conductive elements 940, and the like.

Figure 10:
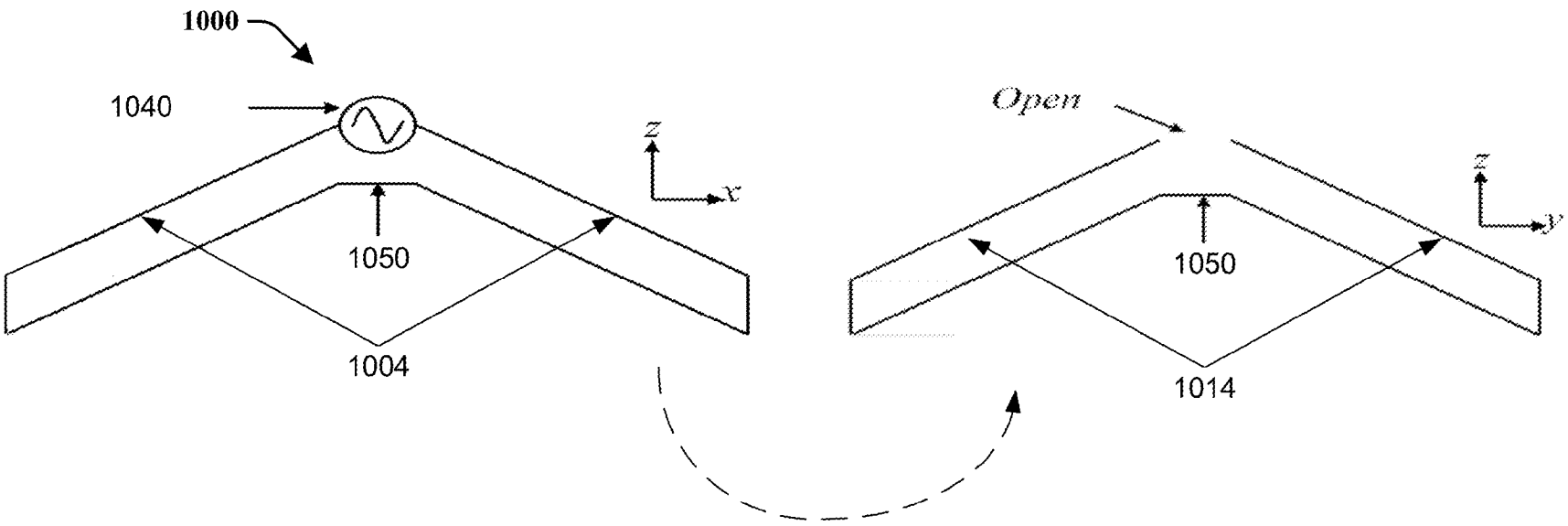
FIG. 10 illustrates a schematic of an example bevel shaped shorted bowtie patch antenna comprising parasitic patch elements, in accordance with various embodiments disclosed herein.

FIG. 10 illustrates a schematic of an example bevel shaped shorted bowtie patch antenna 1000. As depicted, FIG. 10 illustrates bevel shaped shorted bowtie patch antenna 1000 in a cross sectional XZ plane and a cross sectional YZ plane. In the XZ plane, shorted patch elements 1004 are depicted in electrical connection with conductive element 1040. A ground plane 1050 is positioned below the shorted patch elements. In the YZ plane, depicted are parasitic shorted patch elements 1014. As depicted, parasitic shorted patch elements 1014 are not electrically connected to conductive element 1040. While ground plane 1050 and the various patch elements (e.g., shorted patch elements 1004 and parasitic shorted patch elements 1014) are depicted as parallel or having a constant distance from each other, it is noted that the distance can be variable. Likewise, a cavity formed by ground plane 1050 and the various patch elements be filled with a dielectric as described in various embodiments herein.

Figure 11:
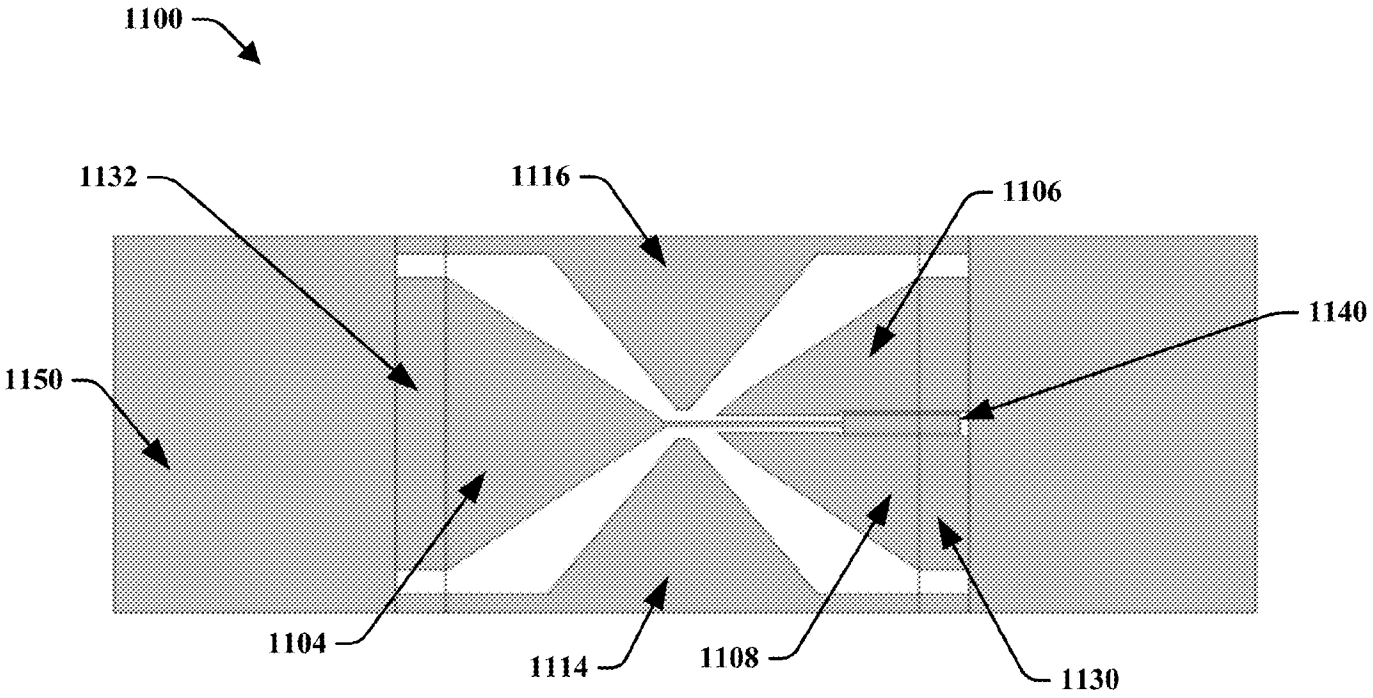
FIG. 11 illustrates a schematic of an example shorted bowtie patch antenna comprising parasitic patch elements prior to folding, in accordance with various embodiments disclosed herein.
Figure 12:
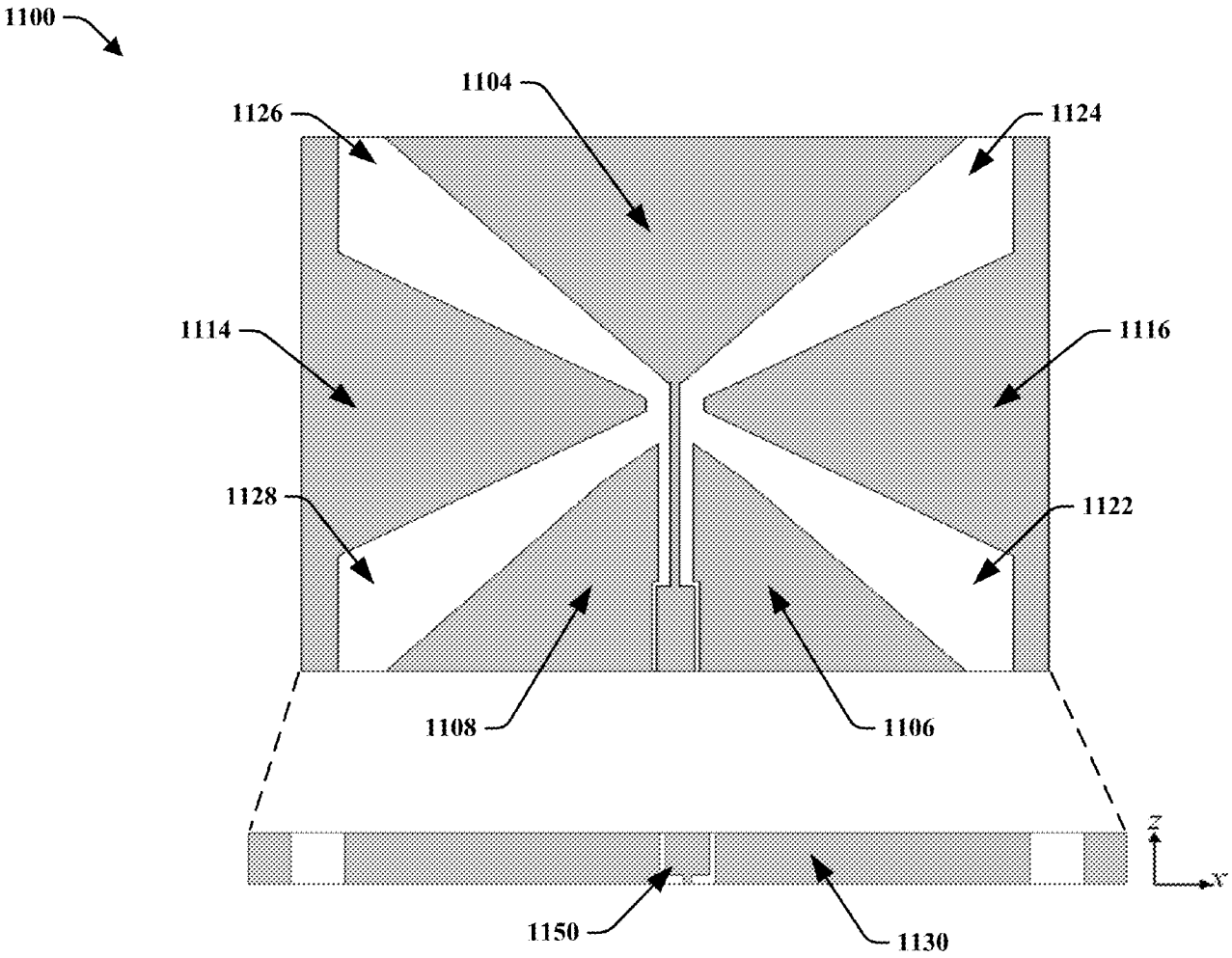
FIG. 12 illustrates a schematic of an example shorted bowtie patch antenna comprising parasitic patch elements after folding, in accordance with various embodiments disclosed herein.

FIGS. 11-12 illustrate a schematic of an example foldable shorted bowtie patch antenna 1100. FIG. 11 illustrates foldable shorted bowtie patch antenna 1100 in a pre-folded or not folded configuration. FIG. 12 illustrates foldable shorted bowtie patch antenna 1100 in a folded configuration. Foldable shorted bowtie patch antenna 1100 can primarily comprise shorted patch elements 1104, 1106, and 1108, parasitic shorted patch elements 1114 and 1116, signal conductor element 1140, slots 1122, 1124, 1126, and 1128, shorting walls 1130 and 1132, and ground plane 1150. While shorted patch elements 1106 and 1108 are depicted as separate elements, it is appreciated that shorted patch elements 1106 and 1108 can be considered a single patch element.

In embodiments, foldable shorted bowtie patch antenna 1100 can be connected to and fed by a coplanar waveguide. In various examples, foldable shorted bowtie patch antenna 1100 can be utilized via a flexible printed circuit broad, conductive ink printed on a medium (e.g., paper), or the like. It is noted that foldable shorted bowtie patch antenna 1100 can comprise various other shapes, can be rolled into shapes, or the like. While foldable shorted bowtie patch antenna 1100 is described as foldable, it is appreciated that "foldable" may refer to rolling into shapes, such as cylindrical shapes, spherical shapes, conical shapes, and the like. Some common shapes, other than rectangles (e.g., prisms), can include circular shapes, pyramidal, triangular, hexagonal, etc. It is further noted that foldable shorted bowtie patch antenna 1100 can be folded into irregular shapes.

Figure 13:
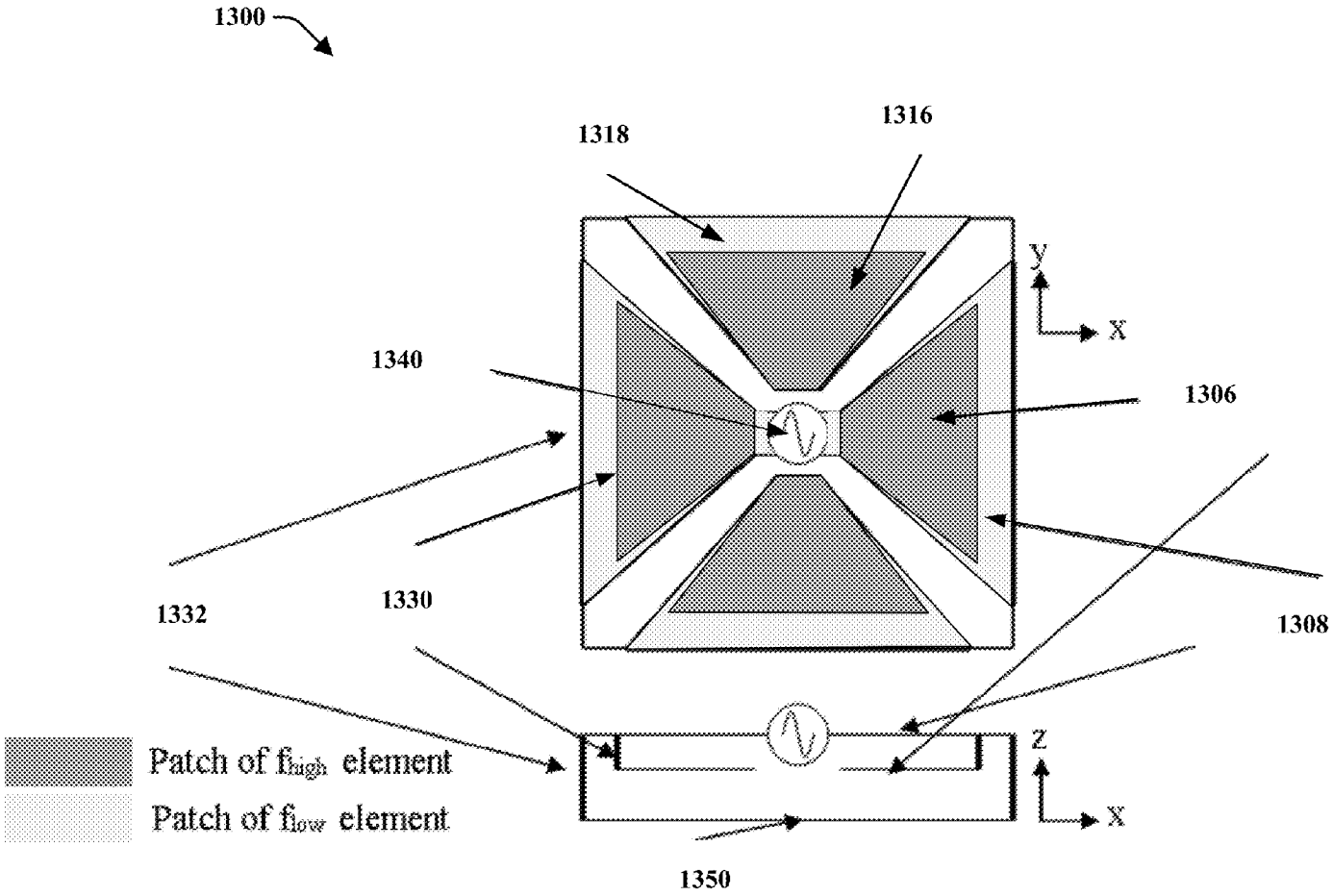
FIG. 13 illustrates a schematic of an example dual-band shorted bowtie patch antenna comprising parasitic patch elements, in accordance with various embodiments disclosed herein.

Turning to FIG. 13, illustrated is a schematic of an example dual-banded shorted bowtie patch antenna 1300 comprising a layered configuration. In an aspect, dual-banded shorted bowtie patch antenna 1300 can primarily comprise shorted patch element 1306 for a first frequency ($f_{high}$), a shorted patch element 1308 for a second frequency ($f_{low}$), a parasitic shorted patch element 1316 for $f_{high}$, a parasitic shorted patch element 1318 for $f_{low}$, shorting wall(s) 1330 for shorted patch element 1306 and/or other patches associated with $f_{high}$, shorting wall 1332 for shorted patch element 1308 and/or other patches associated with $f_{low}$, one or more conductive elements 1340, and ground plane 1350.

In embodiments, dual-banded shorted bowtie patch antenna 1300 can be comprised in larger systems, such as smart phones, tablets, handheld devices, and the like. For example, dual-banded shorted bowtie patch antenna 1300 can be associated with a cellular phone can operate in two frequency bands, such as Global System for Mobile Communication (GSM) (e.g., 880-960 MHz) and 3 G Universal Mobile Telecommunications System (UMTS) Radio band (e.g., 1.92-2.17 GHz). In various embodiments, dual-banded shorted bowtie patch antenna 1300 can be employed with systems comprising a multiband radio, diplexers, or other methods for separating bands. In another embodiment, dual-banded shorted bowtie patch antenna 1300 can be selectively or programably configured for operating in one band at any given time.

In other embodiments, dual-banded shorted bowtie patch antenna 1300 can be configured to operate in other bands according to a desired method of operation. Shorted patch element 1306 and 1308 can each be configured to operate in a specified frequency range. Likewise, parasitic shorted patch elements 1316 and 1318 can also be configured to operate in a specified frequency range. It is noted that the shorted patch element 1306 and 1308 can be fed with a single feed line or multiple feed lines. Further, dual-banded shorted bowtie patch antenna 1300 can comprise other or different elements as described with reference to the various other disclosed embodiments. For instance, dual-banded shorted bowtie patch antenna 1300 can comprise shorting pins, different feeding systems, various shapes, and the like.

Figure 14:
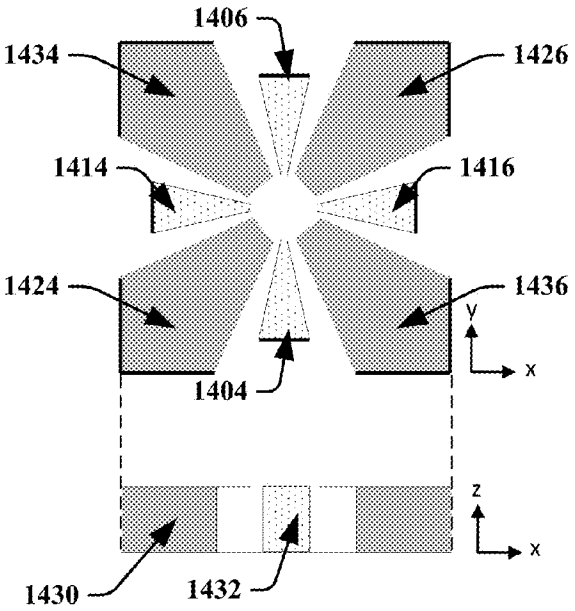
FIG. 14 illustrates a schematic of an example dual-band shorted bowtie patch antenna comprising parasitic patch elements in a pinwheel configuration, in accordance with various embodiments disclosed herein.

Turning to FIG. 14, illustrated is a schematic of an example dual-banded shorted bowtie patch antenna 1400 comprising a pinwheel configuration. Dual-banded shorted bowtie patch antenna 1400 can comprise a first set of patch elements associated with a first band, and a second set of patch elements associated with a second band. In comparison with FIG. 3, the patch elements of the different bands are not layered over each other. For instance, dual-banded shorted bowtie patch antenna 1400 can comprise shorted patch elements 1404 and 1406 for operating on a first band, parasitic shorted patch elements 1414 and 1416 associated with the first band, shorted patch elements 1424 and 1426 for operating on a second band, and parasitic shorted patch elements 1434 and 1436 associated with the second band. In another aspect, shorting wall 1430 can be associated with shorted patch element 1424 and shorting wall 1432 shorted patch element 1404. It is noted that each other patch element can be associated with shorting elements. It is further noted that various aspects of FIG. 14 can be combined with other aspects disclosed herein.

Figure 15:
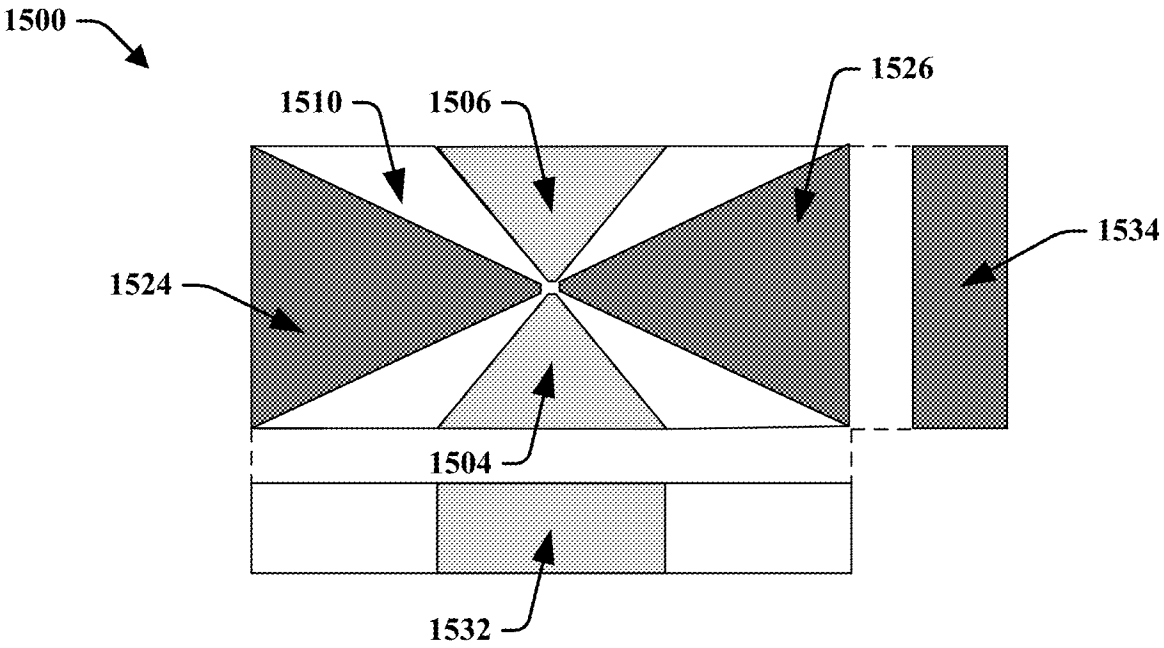
FIG. 15 illustrates a schematic of another example dual-band shorted bowtie patch antenna comprising parasitic patch elements, in accordance with various embodiments disclosed herein.

Turning to FIG. 15, illustrated is a schematic of an example dual-banded shorted bowtie patch antenna 1500. Dual-banded shorted bowtie patch antenna 1500 can comprise shorted patches 1504, 1506, 1524, and 1526, slot element 1510, and shorting walls 1532 and 1534. As depicted, shorted patches 1504 and 1506 (and shorting wall 1532) can be associated with a first band (e.g., $f_{low}$) Likewise, shorted patches 1524 and 1526 (and shorting wall 1534) can be associated with a first band (e.g., $f_{high}$). In an aspect, each band can be associated with a different characteristic relating to a frequency of electrical resonance of associated patch elements.

Figure 16:
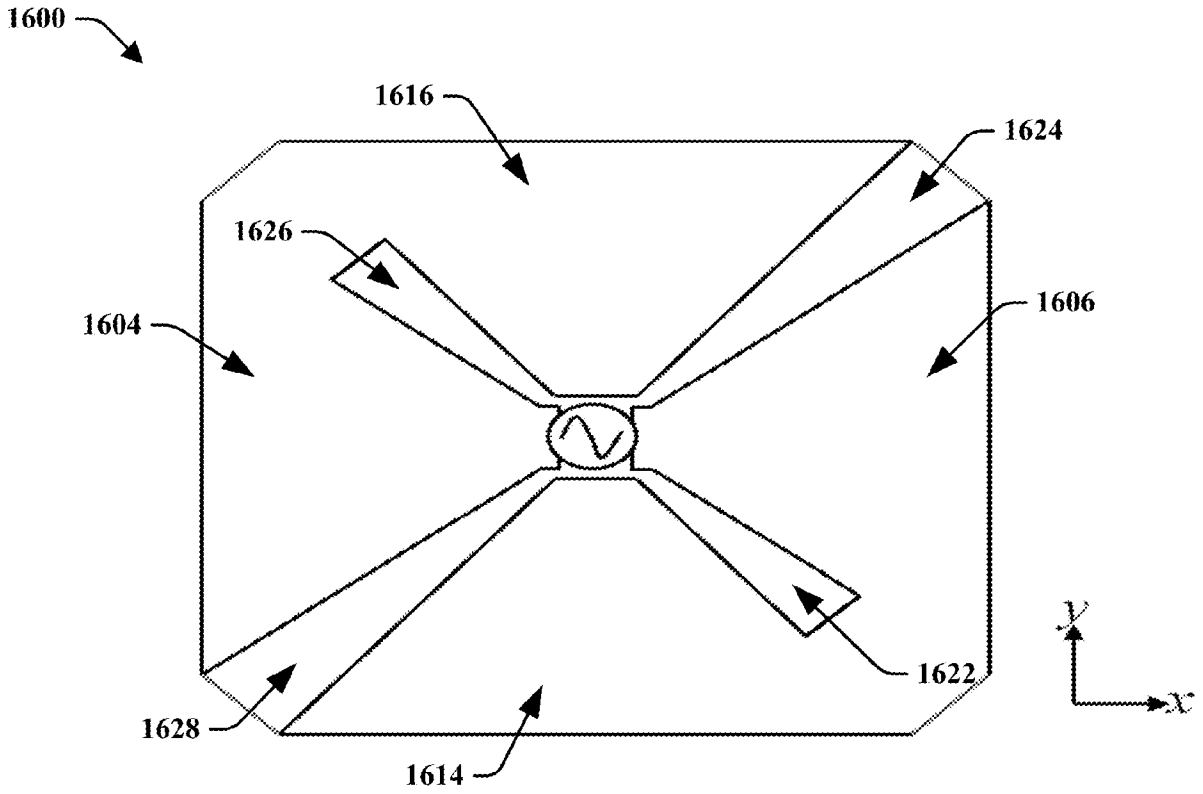
FIG. 16 illustrates a schematic of an example single feed circularly polarized shorted bowtie patch antenna comprising variable length slot elements, in accordance with various embodiments disclosed herein.

FIG. 16 illustrates a schematic of an example shorted bowtie patch antenna 1600 comprising slot elements having different lengths. As depicted, shorted bowtie patch antenna 1600 can comprise shorted patch elements 1604 and 1606, parasitic patch elements 1614 and 1616, slot elements 1622, 1624, 1626, and 1628. As depicted slot elements 1622, 1624, 1626, and 1628 can be of different lengths or dimensions. In an aspect, shorted bowtie patch antenna 1600 can be utilized to generate two orthogonal modes and to facilitate circular polarization.

Figure 17A:
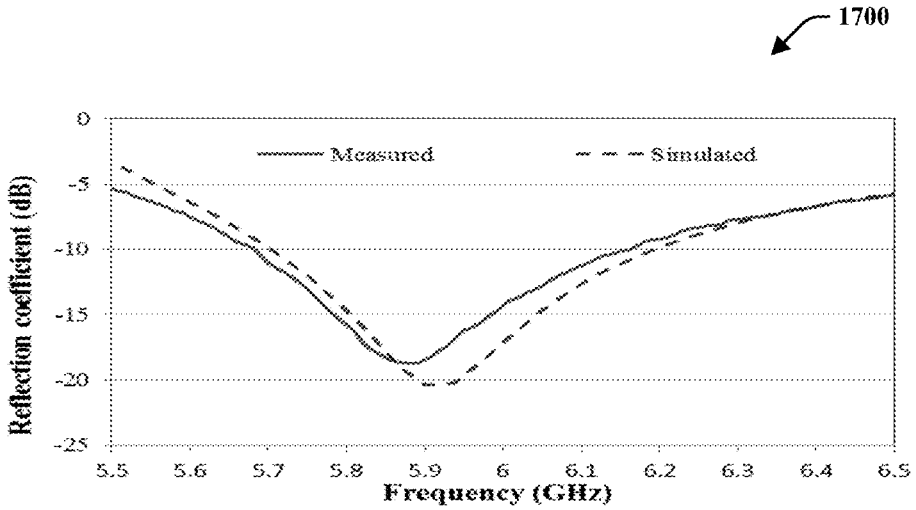
FIG. 17A illustrates a graph of measured and simulated reflection coefficients of an example shorted bowtie patch antenna.
Figure 17B:
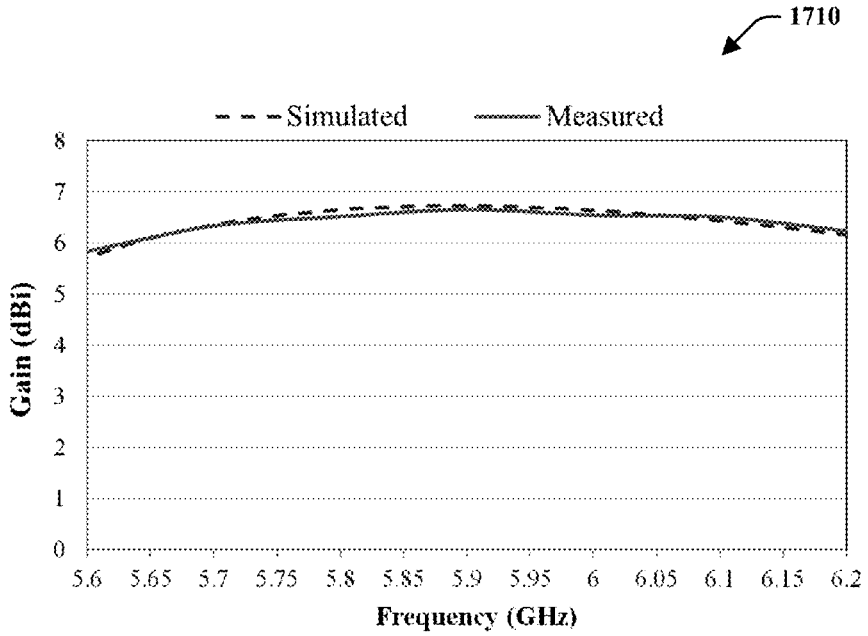
FIG. 17B illustrates a graph of measured and simulated gains of an example shorted bowtie patch antenna.

FIGS. 17A and 17B depict graphs 1700 and 1710, respectively. Graph 1700 illustrates measured (solid line) and simulated (dashed line) reflection coefficients of an example shorted bowtie patch antenna with parasitic patches. The antenna has a measured impedance bandwidth (with reflection coefficient less than −10 dB) of 8.12%, from 5.68 GHz to 6.16 GHz. The corresponding simulation is from 5.7 GHz to 6.2 GHz, which is 8.4%. It is noted that the antenna can fully cover the 5.8 GHz ISM band that is from 5.725 GHz to 5.875 GHz.

Graph 1710 illustrates measured (solid line) and simulated (dashed line) gains of the proposed antenna at ($\theta$, $\Phi$)=(0°, 0°). The simulation is from 5.7 GHz to 6.2 GHz. As depicted, both gains are around 6.5 dBi across the operating frequency band.

Figure 18:
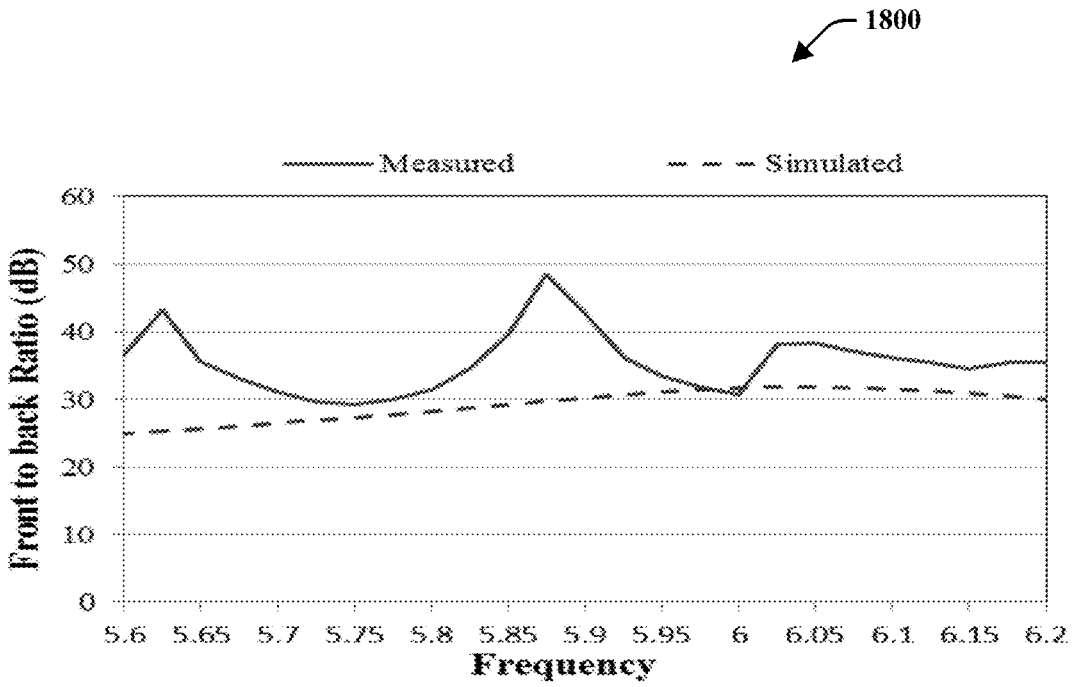
FIG. 18 illustrates a graph of measured and simulated front-to-back ratios of an example shorted bowtie patch antenna.

FIG. 18A is a graph 1800 illustrating an effect on front-to-back ratios according to an aspect of this disclosure. The simulation is from 5.7 GHz to 6.2 GHz on an exemplary antenna as described herein. As depicted, both of the measured and simulated front-to-back ratios are higher than 25 dB across the operating frequency band.

Figure 19A:
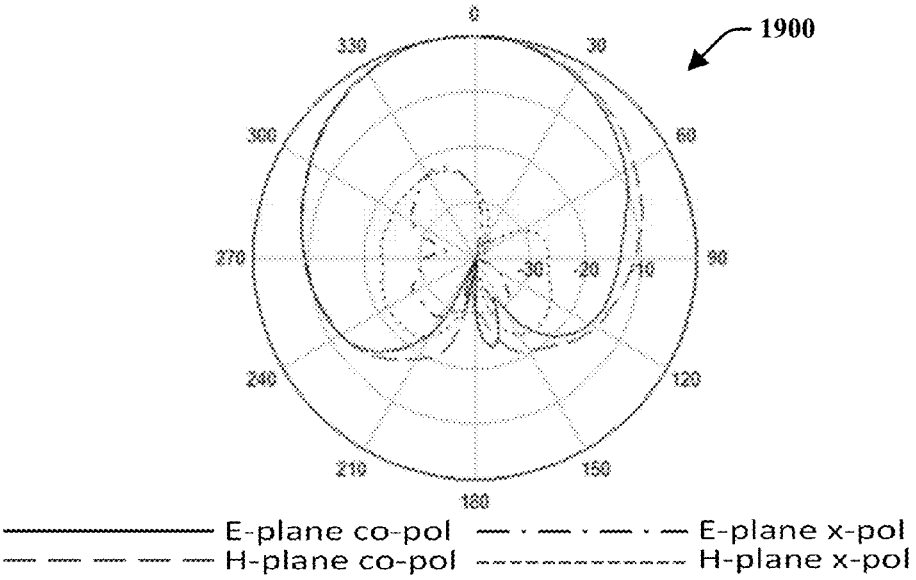
FIG. 19A illustrates a graph of measured radiation patterns of an example shorted bowtie patch antenna.
Figure 19B:
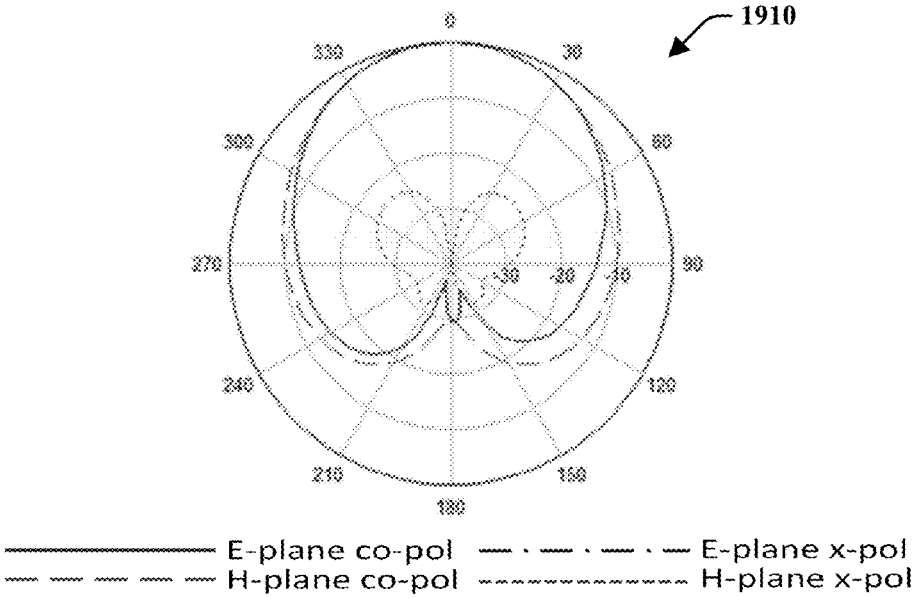
FIG. 19B illustrates a graph of simulated radiation patterns of an example shorted bowtie patch antenna.

FIGS. 19A and 19B are graphs 1900 and 1910 respectively. Graphs 1900 and 1910 illustrate measured (graph 1900) and simulated (graph 1910) radiation patterns at 5.875 GHz. In both E and H planes, the broadside radiation patterns are stable (or substantially stable) and symmetrical (or substantially symmetrical). It is noted that, low cross polarization and low back radiation are observed across the entire operating bandwidth. Radiation pattern refers to the directional (angular) dependence of the strength of the radio waves from the antenna. For instance, omnidirectional radiation patterns radiate equal power in all directions perpendicular to the antenna. The power varies from the angle to the axis and drops to zero on the antenna's axis. This illustrates the general principle that if the shape of an antenna is symmetrical, its radiation pattern will have the same symmetry.

Figure 20:
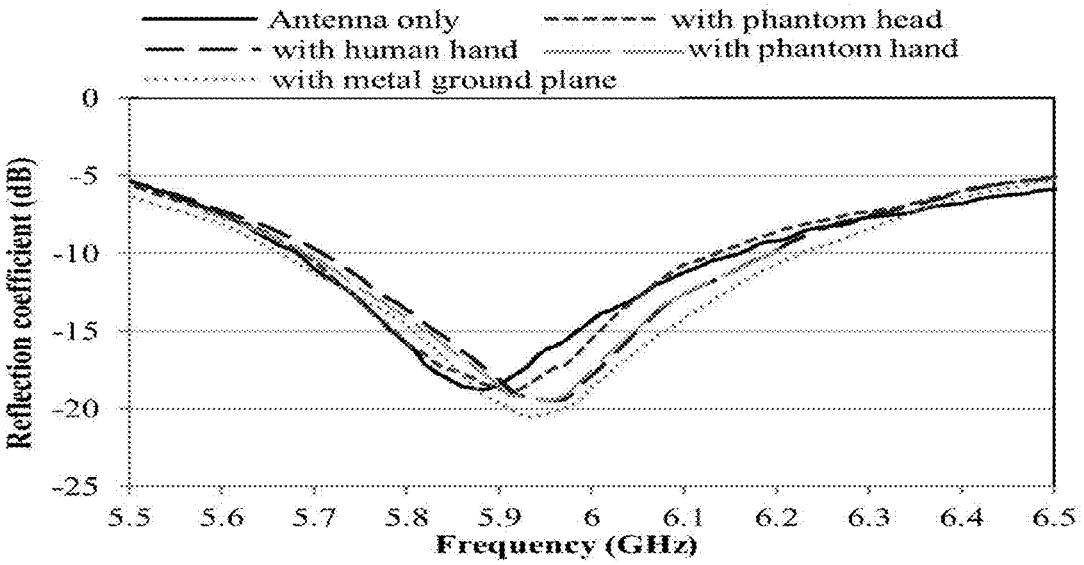
FIG. 20 illustrates a graph of measured reflection coefficients of an example shorted bowtie patch antenna associated with different mounting surfaces.

FIG. 20 is a graph 2000 illustrating an effect on reflection coefficients of an exemplary antenna when mounted or affixed to different surfaces. The exemplary antenna is mounted on four types of surfaces (phantom head, human hand, phantom hand, and metal ground plane) and is also compared to reflection coefficients of the antenna itself. The term "phantom" is used to describe an object that is not physically in contact with the antenna, but is in close proximity to affect parameters of the antenna. It is noted that there are only slight differences on the bandwidth and the resonant frequency among the different mounting surfaces.

Figure 21A:
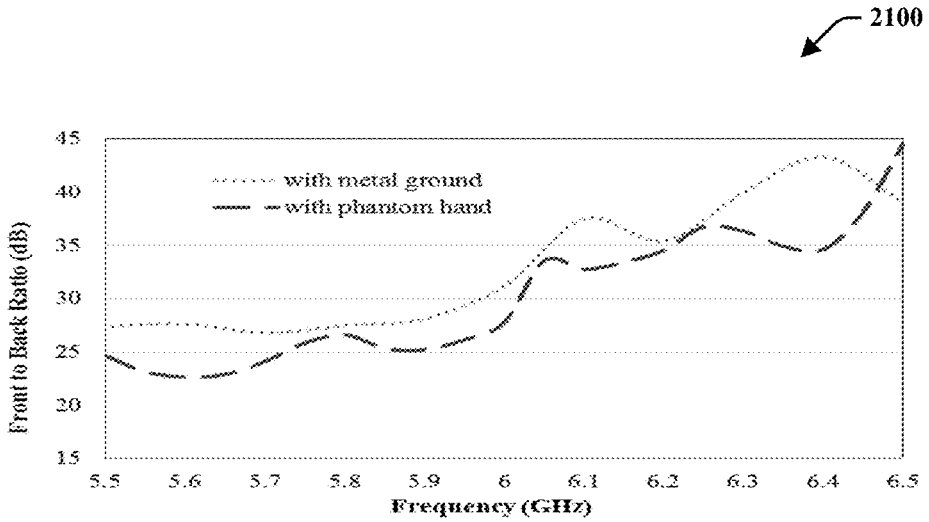
FIG. 21A illustrates a graph of measured front-to-back ratios of an example shorted bowtie patch antenna associated with different mounting surfaces.
Figure 21B:
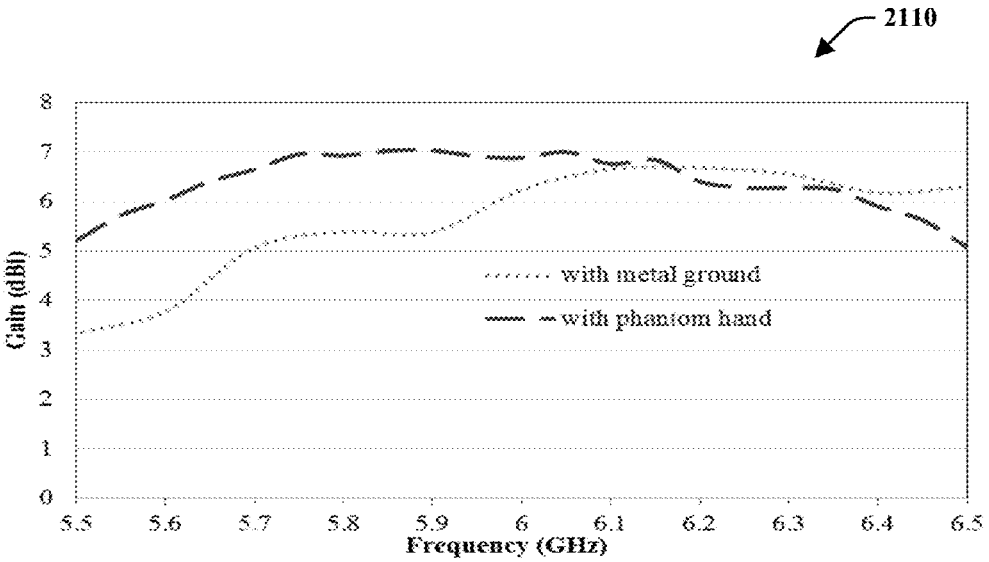
FIG. 21B illustrates a graph of gains of an example shorted bowtie patch antenna associated with different mounting surfaces.

FIGS. 21A and 21B are graphs 2100 and 2110. Graphs 2100 and 2110 illustrate measured front-to-back ratios and measured gains of an exemplary antenna when mounting on a metal ground plane and a phantom hand, in accordance with aspects disclosed herein. As shown in graph 2000 the front-to-back ratio of the metal ground plane case is over 27 dB and the front-to-back ratio of the phantom hand case is higher than 24 dB across a 5.8 GHz ISM band. As shown in graph 2010, the gain of the metal ground plane case is over 5 dB and the gain of the phantom hand case is higher than 6.5 dB across the 5.8 GHz ISM band.

Figure 22A:
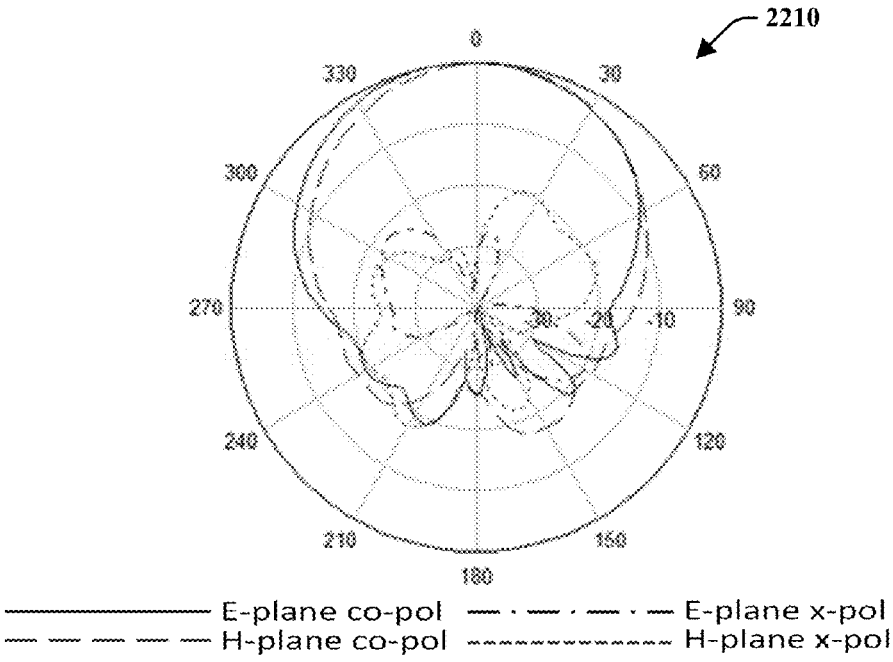
FIG. 22A illustrates a graph of measured radiation patterns of an example shorted bowtie patch antenna associated with different mounting surfaces.
Figure 22B:
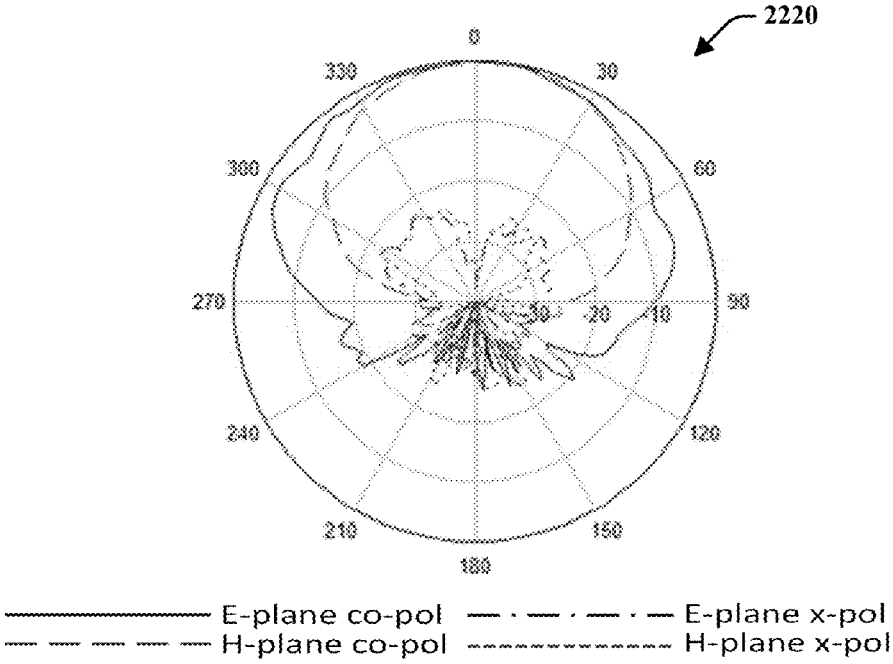
FIG. 22B illustrates a graph of simulated radiation patterns of an example shorted bowtie patch antenna associated with different mounting surfaces.

FIGS. 22A and 22B are graphs 2200 and 2210. Graphs 2200 and 2210 respectively illustrate measured radiation patterns of the antenna when mounting on a metal ground plane and a phantom hand, in accordance with aspects disclosed herein. In both E and H planes, the broadside radiation patterns are stable (or substantially stable) and symmetrical (or substantially symmetrical). It is noted that the graphs 2200 and 2210 demonstrate low back radiation for both cases.

In view of exemplary systems and devices shown and described above, methods that may be implemented in accordance with the disclosed subject matter, will be better appreciated with reference to various flow charts. While, for purposes of simplicity of explanation, methods are shown and described as a series of blocks, it is to be understood and appreciated that the claimed subject matter is not limited by the number or order of blocks, as some blocks may occur in different orders and/or at substantially the same time with other blocks from what is depicted and described herein. Moreover, not all illustrated blocks may be required to implement methods described herein. It is to be appreciated that functionality associated with blocks may be implemented by software, hardware, a combination thereof or any other suitable means (e.g. device, system, process, component). Additionally, it can be further appreciated that methods disclosed throughout this specification are capable of being stored on an article of manufacture to facilitate transporting and transferring such methods to various devices. Those skilled in the art will understand and appreciate that a method could alternatively be represented as a series of interrelated states or events, such as in a state diagram.

Figure 23:
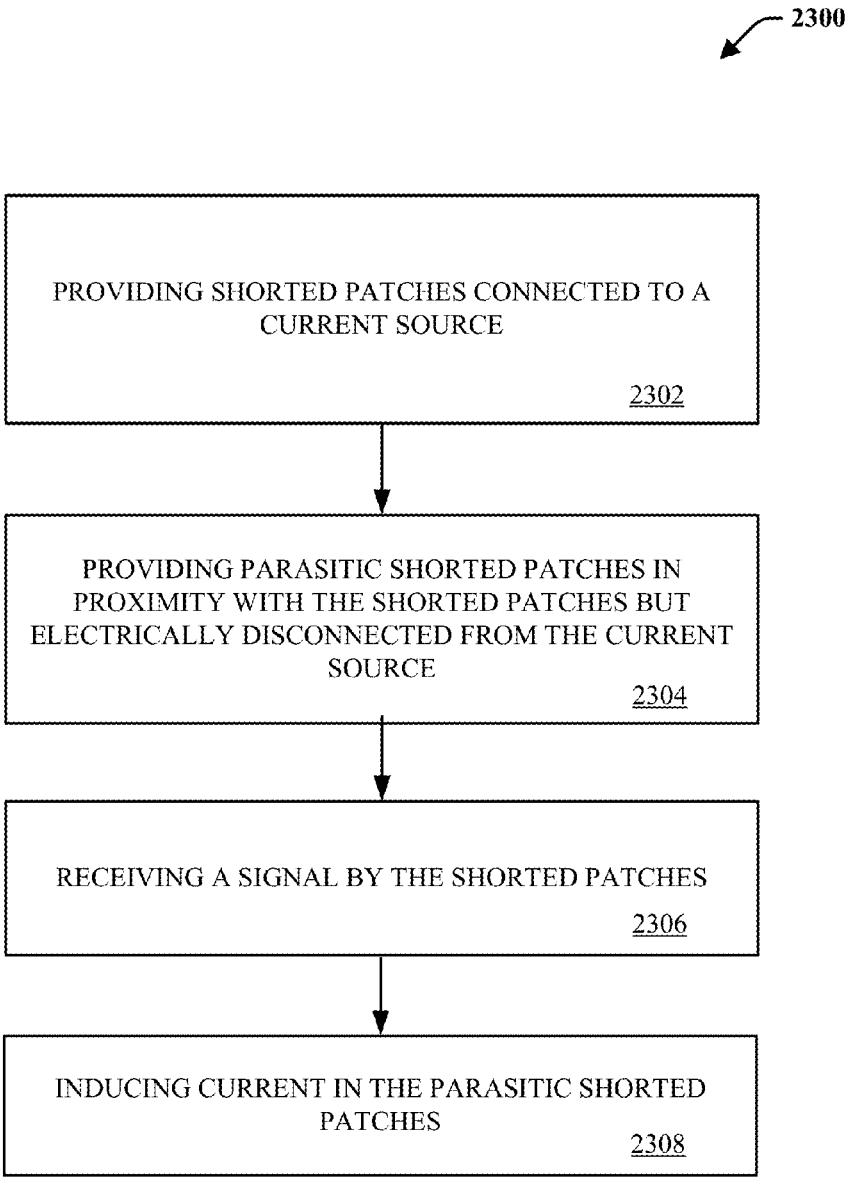
FIG. 23 illustrates a method for manufacturing and utilizing an example shorted bowtie patch antenna, according to aspects disclosed herein.

FIG. 23 illustrates a method 2300 for manufacturing and utilizing a shorted bowtie patch antenna with parasitic shorted patches, according to an aspect. For example, method 2300 can be utilized to manufacture an antenna (e.g., shorted bowtie patch antenna 100, etc.) and facilitate transmissions associated with the antenna.

At 2302, shorted patches connected to a current source can be provided. In an aspect, the patches can be attached or affixed to a ground plane element. In another aspect, the shorted patches can be printed, chemically deposited, or otherwise formed. The shorted patches can be referred to as driving patches that receive or transmit signals. In an aspect, proving shorted patches can comprise providing shorting elements (e.g., shorting walls, shorting pins, etc.)

At 2304, parasitic shorted patches can be provided in proximity with the shorted patches, but electrically disconnected from the current source. For instance, parasitic shorted patches can be configured in a bowtie shape and the shorted patches can also be configured in a bowtie shape. These bowtie shapes can be intersected at a central point or reference point to form a "T" or cross shape. It is noted that different numbers of shorted patch elements and parasitic shorted patch elements can be utilized, such as for dual or multi-band applications. It is further noted that the shorted patch elements and parasitic shorted patch elements can comprise various configurations as described herein.

In some embodiments, method 2300 can include providing a cavity (or cavities), formed by the various patch elements and a ground plane, and filling the cavity with a dielectric such as air, or another dielectric material. It is noted that method 2300 can comprise attaching an antenna to a source (e.g., transmitter/receiver, etc.). It is further noted that providing the various patches can include providing or forming slot elements in an antenna. For instance, slot elements can be etched and a patch element can be formed based on the etching.

At 2306, the shorted patches can receive a signal. The signal can be a signal received from a source (e.g., transmitter) connected to an antenna. In another aspect, the signal can be signals received over an airway (e.g., a signal sent from a different antenna). At 2308, a current can be induced in the parasitic shorted patches. In an aspect, the current is induced based on the signal received by the shorted patches.

Figure 24:
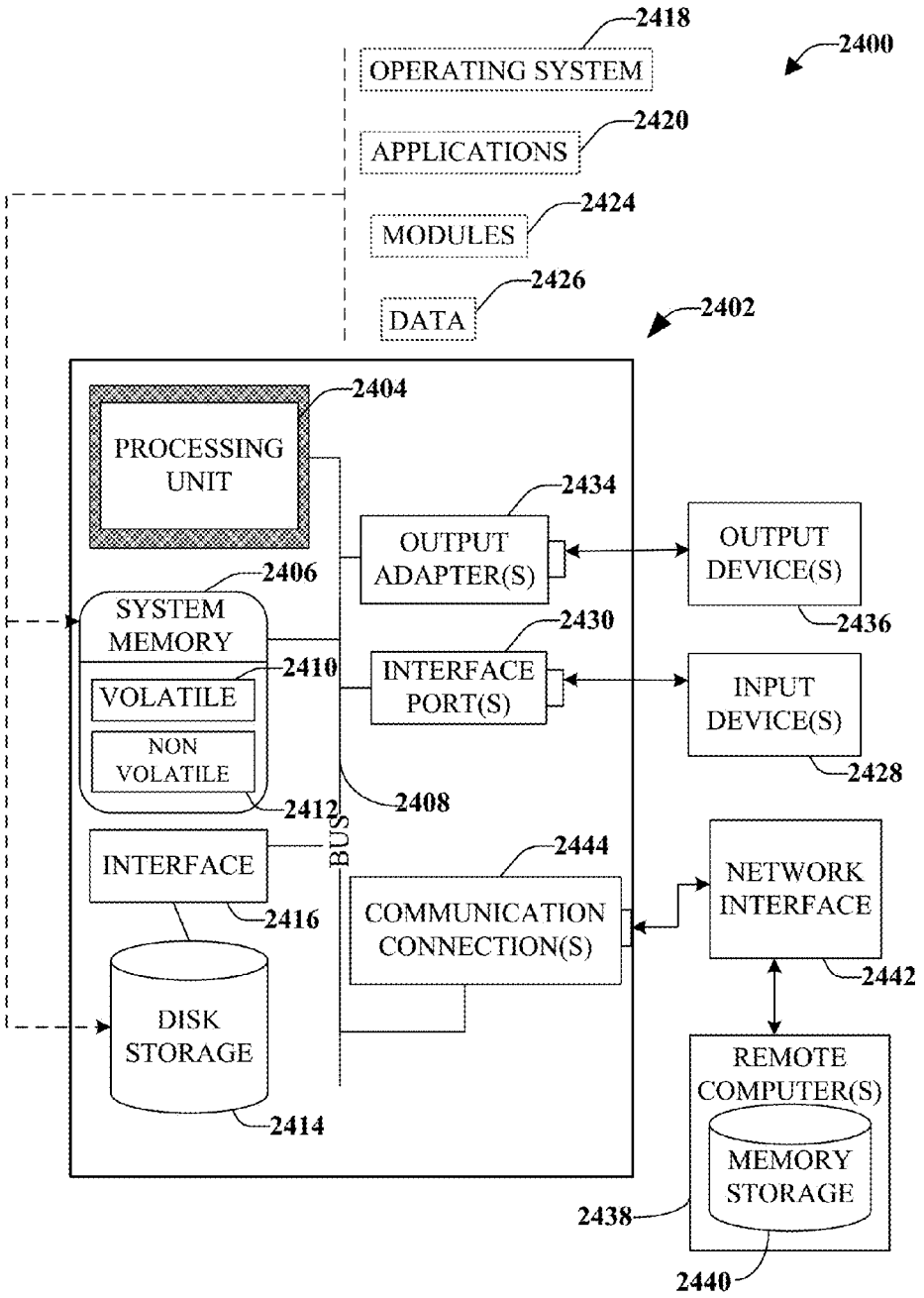
FIG. 24 illustrates a schematic block diagram illustrating a suitable operating environment.

In order to provide a context for the various aspects of the disclosed subject matter, FIGS. 24 and 16 as well as the following discussion are intended to provide a brief, general description of a suitable environment in which the various aspects of the disclosed subject matter may be implemented. While the subject matter has been described above in the general context of computer-executable instructions of a computer program that runs on a computer and/or computers, those skilled in the art will recognize that the subject disclosure also may be implemented in combination with other program modules. Generally, program modules include routines, programs, components, data structures, etc. that perform particular tasks and/or implement particular abstract data types. Moreover, those skilled in the art will appreciate that the disclosed methods may be practiced with other computer system configurations, including single-processor or multiprocessor computer systems, mini-computing devices, mainframe computers, as well as personal computers, hand-held computing devices (e.g., personal digital assistant (PDA), phone), microprocessor-based or programmable consumer or industrial electronics, and the like. The illustrated aspects may also be practiced in distributed computing environments where tasks are performed by remote processing devices that are linked through a communications network. However, some, if not all aspects of the subject disclosure can be practiced on stand-alone computers. In a distributed computing environment, program modules may be located in both local and remote memory storage devices.

With reference to FIG. 24, a suitable environment 2400 for implementing various aspects of the claimed subject matter includes a computer 2412. For instance, computer 2412 can comprise one or more antennas and/or communicate with one or more antennas as described herein. The computer 2412 includes a processing unit 2414, a system memory 2416, and a system bus 2418. The system bus 2418 couples system components including, but not limited to, the system memory 2416 to the processing unit 2414. The processing unit 2414 can be any of various available processors. Dual microprocessors and other multiprocessor architectures also can be employed as the processing unit 2414.

The system bus 2418 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 2416 includes volatile memory 2420 and nonvolatile memory 2422. The basic input/output system (BIOS), containing the basic routines to transfer information between elements within the computer 2412, such as during start-up, is stored in nonvolatile memory 2422. By way of illustration, and not limitation, nonvolatile memory 2422 can include read only memory (ROM), programmable ROM (PROM), electrically programmable ROM (EPROM), electrically erasable programmable ROM (EEPROM), or flash memory. Volatile memory 2420 includes random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 2412 also includes removable/non-removable, volatile/non-volatile computer storage media. FIG. 24 illustrates, for example, a disk storage 2424. Disk storage 2424 includes, but is not limited to, devices such as a magnetic disk drive, floppy disk drive, tape drive, Jaz drive, Zip drive, LS-100 drive, flash memory card, or memory stick. In addition, disk storage 2424 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 2424 to the system bus 2418, a removable or non-removable interface is typically used, such as interface 2426).

It is to be appreciated that FIG. 24 describes software that acts as an intermediary between users and the basic computer resources described in the suitable operating environment 2400. Such software includes an operating system 2428. Operating system 2428, which can be stored on disk storage 2424, acts to control and allocate resources of the computer system 2412. System applications 2430 take advantage of the management of resources by operating system 2428 through program modules 2432 and program data 2434 stored either in system memory 2416 or on disk storage 2424. It is to be appreciated that the claimed subject matter can be implemented with various operating systems or combinations of operating systems.

A user enters commands or information into the computer 2412 through input device(s) 2436. Input devices 2436 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 2414 through the system bus 2418 via interface port(s) 2438. Interface port(s) 2438 include, for example, a serial port, a parallel port, a game port, and a universal serial bus (USB). Output device(s) 2440 use some of the same type of ports as input device(s) 2436. Thus, for example, a USB port may be used to provide input to computer 2412, and to output information from computer 2412 to an output device 2440. Output adapter 2442 is provided to illustrate that there are some output devices 2440 such as monitors, speakers, and printers, among other output devices 2440, which require special adapters. The output adapters 2442 include, by way of illustration and not limitation, video and sound cards that provide a means of connection between the output device 2440 and the system bus 2418. It is noted that other devices and/or systems of devices provide both input and output capabilities such as remote computer(s) 2444.

Computer 2412 can operate in a networked environment using logical connections to one or more remote computers, such as remote computer(s) 2444. The remote computer(s) 2444 can be a personal computer, a server, a router, a network PC, a workstation, a microprocessor based appliance, a peer device or other common network node and the like, and typically includes many or all of the elements described relative to computer 2412. For purposes of brevity, only a memory storage device 2446 is illustrated with remote computer(s) 2444. Remote computer(s) 2444 is logically connected to computer 2412 through a network interface 2448 and then physically connected via communication connection 2450. Network interface 2448 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks such as Integrated Services Digital Networks (ISDN) and variations thereon, packet switching networks, and Digital Subscriber Lines (DSL).

Communication connection(s) 2450 refers to the hardware/software employed to connect the network interface 2448 to the bus 2418. While communication connection 2450 is shown for illustrative clarity inside computer 2412, it can also be external to computer 2412. The hardware/software necessary for connection to the network interface 2448 includes, for exemplary purposes only, internal and external technologies such as, modems including regular telephone grade modems, cable modems and DSL modems, ISDN adapters, and Ethernet cards.

Figure 25:
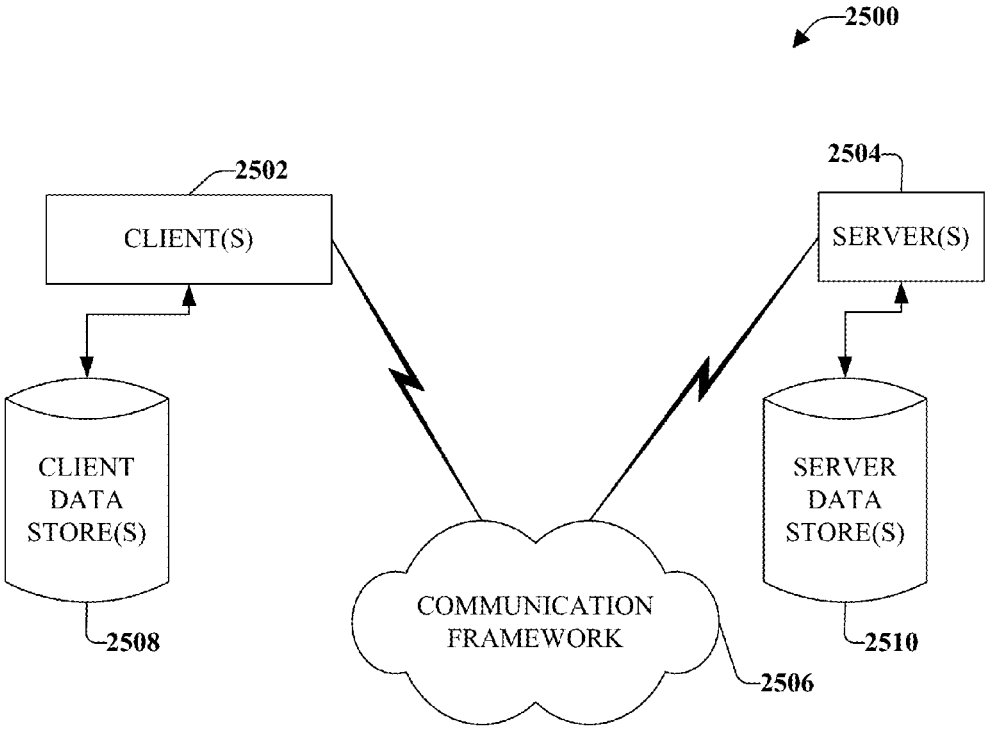
FIG. 25 illustrates a schematic block diagram of a sample-computing environment.

FIG. 25 is a schematic block diagram of a sample-computing environment 2500 with which the subject disclosure can interact. The system 2500 includes one or more client(s) 2502. The client(s) 2502 can be hardware and/or software (e.g., threads, processes, computing devices). The system 2500 also includes one or more server(s) 2504. Thus, system 2500 can correspond to a two-tier client server model or a multi-tier model (e.g., client, middle tier server, data server), amongst other models. The server(s) 2504 can also be hardware and/or software (e.g., threads, processes, computing devices). The servers 2504 can house threads to perform transformations by employing the subject disclosure, for example. One possible communication between a client 2502 and a server 2504 may be in the form of a data packet transmitted between two or more computer processes. In embodiments, various components of system 2500 (e.g., client(s) 2502, server(s) 2504, etc.) can comprise one or more antennas and/or communicate with one or more antennas as described herein.

The system 2500 includes a communication framework 2506 that can be employed to facilitate communications between the client(s) 2502 and the server(s) 2504. The client(s) 2502 are operatively connected to one or more client data store(s) 2508 that can be employed to store information local to the client(s) 2502. Similarly, the server(s) 2504 are operatively connected to one or more server data store(s) 2510 that can be employed to store information local to the servers 2504.

Some portions of the detailed description have been presented in terms of algorithms and/or symbolic representations of operations on data bits within a computer memory. These algorithmic descriptions and/or representations are the means employed by those cognizant in the art to most effectively convey the substance of their work to others equally skilled. An algorithm is here, generally, conceived to be a self-consistent sequence of acts leading to a desired result. The acts are those requiring physical manipulations of physical quantities. Typically, though not necessarily, these quantities take the form of electrical and/or magnetic signals capable of being stored, transferred, combined, compared, and/or otherwise manipulated.

It has proven convenient at times, principally for reasons of common usage, to refer to these signals as bits, values, elements, symbols, characters, terms, numbers, or the like. It is also noted, however, that all of these and similar terms are to be associated with the appropriate physical quantities and are merely convenient labels applied to these quantities. Unless specifically stated otherwise as apparent from the foregoing discussion, it is appreciated that throughout the disclosed subject matter, discussions utilizing terms such as processing, computing, calculating, determining, and/or displaying, and the like, refer to the action and processes of computer systems, and/or similar consumer and/or industrial electronic devices and/or machines, that manipulate and/or transform data represented as physical (electrical and/or electronic) quantities within the computer's and/or machine's registers and memories into other data similarly represented as physical quantities within the machine and/or computer system memories or registers or other such information storage, transmission and/or display devices.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

In the subject specification and annexed drawings, terms such as "store," "data store," "data storage," "database," and substantially any other information storage component relevant to operation and functionality of a component, refer to "memory components," or entities embodied in a "memory" or components comprising the memory. It will be appreciated that the memory components described herein can be either volatile memory or nonvolatile memory, or can include both volatile and nonvolatile memory.

By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and dire Rambus RAM (DRRAM). Additionally, the disclosed memory components of systems or methods herein are intended to comprise, without being limited to comprising, these and any other suitable types of memory.

Various aspects or features described herein can be implemented as a method, apparatus, or article of manufacture using standard programming and/or engineering techniques. In addition, various aspects disclosed in the subject specification can also be implemented through program modules stored in a memory and executed by a processor, or other combination of hardware and software, or hardware and firmware.

Computing devices typically include a variety of media, which can include computer-readable storage media or communications media, which two terms are used herein differently from one another as follows.

Computer-readable storage media can be any available storage media that can be accessed by the computer and includes both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

What has been described above includes examples of systems and methods that provide advantages of the subject aspects. It is, of course, not possible to describe every conceivable combination of components or methods for purposes of describing the subject aspects, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

As used in this application, the terms "component," "system," and the like are intended to refer to a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, a program, and/or a computer. By way of illustration, both an application running on a server or network controller, and the server or network controller can be a component. One or more components may reside within a process and/or thread of execution and a component may be localized on one computer and/or distributed between two or more computers. Also, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software, or firmware application executed by a processor, wherein the processor can be internal or external to the apparatus and executes at least a part of the software or firmware application. As yet another example, a component can be an apparatus that provides specific functionality through electronic components without mechanical parts, the electronic components can include a processor therein to execute software or firmware that confers at least in part the functionality of the electronic components. As further yet another example, interface(s) can include input/output (I/O) components as well as associated processor, application, or Application Programming Interface (API) components.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings are generally be construed to mean "one or more" unless specified otherwise or clear from context to be directed to a singular form.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding FIGs, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A shorted bowtie antenna assembly, comprising:

shorted patch elements of first respective surfaces positioned above a ground plane, wherein a first shorted patch element of the shorted patch elements is electrically connected to a tapered portion of a conductive element, and wherein a second shorted patch element of the shorted patch elements is electrically coupled to a non-tapered portion of the conductive element that is connected to a feed element;

parasitic patch elements of second respective surfaces positioned above the ground plane and physically separated from the conductive element and the shorted patch elements; and shorting elements coupled to the ground plane and at least one of the shorted patch elements, or at least one of the parasitic patch elements.

2. The shorted bowtie antenna assembly of claim 1, further comprising:

at least one cavity between the ground plane and at least one of the shorted patch elements or the parasitic patch elements.

3. The shorted bowtie antenna assembly of claim 1, wherein the conductive element is configured to connect to a source element that provides or receives a signal.

4. The shorted bowtie antenna assembly of claim 1, wherein the parasitic patch elements are physically separated from the shorted patch elements using slots.

5. The shorted bowtie antenna assembly of claim 4, wherein at least one of the slots has a different length from at least another one of the slots.

6. The shorted bowtie antenna assembly of claim 1, wherein at least one of the shorted patch elements or at least one of the parasitic patch elements comprises a shape representing a triangle.

7. The shorted bowtie antenna assembly of claim 1, wherein the shorting elements comprise at least one of a shorting wall or a shorting pin.

8. The shorted bowtie antenna assembly of claim 1, wherein upper sides of the shorted patch elements and the parasitic patch elements are substantially coplanar.

9. The shorted bowtie antenna assembly of claim 1, wherein the shorted patch elements and the parasitic patch elements are curved.

10. The shorted bowtie antenna assembly of claim 1, wherein the shorted patch elements and the parasitic patch elements are arranged in a bevel configuration.

11. The shorted bowtie antenna assembly of claim 1, wherein the bowtie antenna assembly is foldable.

12. The shorted bowtie antenna assembly of claim 1, wherein at least a portion of the feed element is included within a dielectric material.

13. An antenna apparatus, comprising:

a first set of patch elements, comprising:

a first patch element comprising a first surface positioned above a ground plane and a second patch element comprising a second surface positioned above the ground plane, wherein the first patch element is electrically connected to a tapered portion of a conductive element, and wherein the second patch element is electrically coupled to a non-tapered portion of the conductive element that is connected to a feed element, a first parasitic patch element comprising a third surface positioned above the ground plane and galvanically isolated from the conductive element, the first patch element, and the second patch element, and a second parasitic patch element comprising a fourth surface positioned above the ground plane and galvanically isolated from the conductive element, the first patch element, and the second patch element; and shorting elements coupled to the ground plane and at least one of the first set of patch elements.

14. The antenna apparatus of claim 13, wherein the first set of patch elements comprise a first characteristic relating to a first frequency of electrical resonance of the first set of patch elements, and wherein the antenna apparatus further comprises a second set of patch elements comprising a second characteristic relating to a second frequency of electrical resonance of the second set of patch elements.

15. The antenna apparatus of claim 13, wherein the first patch element, the second patch element, the first parasitic patch element, and the second parasitic patch element are arranged in a bowtie configuration.

16. The antenna apparatus of claim 13, wherein the conductive element is configured to transmit or receive a signal, wherein the antenna apparatus further comprises a source element comprising a set of feeding probes, and wherein at least one feeding probe of the set of feeding probes is connected to a first element that generates a first signal and at least one other feeding probe of the set of feeding probes is connected to a second element that generates a second signal.

17. The antenna apparatus of claim 16, wherein the set of feeding probes are configured for at least one of linear polarization of signals associated with the first set of patch elements or circular polarization of signals associated with the first set of patch elements.

18. An antenna system, comprising:

patch elements comprising respective patch surfaces positioned above a ground plane element, wherein a first patch element of the patch elements is electrically connected to a tapered portion of a source element, and wherein a second patch element of the patch elements is electrically coupled to a non-tapered portion of the source element that is connected to a feed element;

parasitic patch elements comprising respective parasitic surfaces positioned above the ground plane element and physically separated, via slot elements, from the source element and the respective patch surfaces; and shorting elements coupled to the ground plane element and at least one of the patch elements or the parasitic patch elements.

19. The antenna system of claim 18, wherein the source element is configured to transmit or receive a signal.

20. The antenna system of claim 18, wherein the antenna system is mounted on a surface.

21. The antenna system of claim 18, further comprising a flexible printed circuit board coupled to the antenna system.

* * * * *